US011013322B2

(12) United States Patent
Kim

(10) Patent No.: US 11,013,322 B2
(45) Date of Patent: May 25, 2021

(54) REFRIGERATOR

(71) Applicant: LG ELECTRONICS INC., Seoul (KR)

(72) Inventor: Jinsung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/582,831

(22) Filed: Sep. 25, 2019

(65) Prior Publication Data

US 2021/0007481 A1 Jan. 14, 2021

(30) Foreign Application Priority Data

Jul. 12, 2019 (KR) ..... 10-2019-0084453

(51) Int. Cl.
*A47B 88/90* (2017.01)
*F25D 25/02* (2006.01)
*F25D 23/02* (2006.01)

(52) U.S. Cl.
CPC ..... *A47B 88/90* (2017.01); *F25D 23/021* (2013.01); *F25D 25/025* (2013.01); *A47B 2088/901* (2017.01); *A47B 2210/0094* (2013.01); *A47B 2210/175* (2013.01)

(58) Field of Classification Search
CPC ..... A47B 88/90; A47B 2088/901; A47B 2210/0094; A47B 2210/175; A47B 96/027; A47B 96/067; F25D 25/025; F25D 23/021
USPC ..... 312/235.1, 235.2, 402, 404
See application file for complete search history.

(56) References Cited

U.S. PATENT DOCUMENTS 658,999 A * 10/1900 Scannell
2,072,244 A * 3/1937 Coursen ..... B41J 29/08 248/632
2,679,658 A * 6/1954 McCormick ..... A47L 23/16 15/265
2,731,318 A * 1/1956 Hoff ..... A47B 67/005 312/210
4,545,628 A * 10/1985 Richey ..... A47B 97/00 182/17

(Continued)

FOREIGN PATENT DOCUMENTS

CN 100417900 9/2008
CN 202254607 5/2012

(Continued)

OTHER PUBLICATIONS

European Search Report dated Mar. 12, 2020 issued in Application No. 19199586.9.

(Continued)

*Primary Examiner* — Janet M Wilkens
(74) *Attorney, Agent, or Firm* — Ked & Associates LLP

(57) ABSTRACT

A refrigerator may include: a cabinet, a drawer, and a shock absorption module. The shock absorption module may be provided on a lower surface of a front panel (constituting the drawer) and may be configured to absorb a shock caused by a hitting on a floor when the drawer is opened. A user may be prevented from suffering a safety accident caused by automatic opening of the drawer, and the user may easily install the shock absorption module and easily perform maintenance thereof.

14 Claims, 42 Drawing Sheets

(56) References Cited

U.S. PATENT DOCUMENTS

| | | | | |
|---|---|---|---|---|
| 5,253,488 | A * | 10/1993 | Kim | A23L 3/3427 62/382 |
| 6,044,606 | A * | 4/2000 | Hamar | E04F 15/225 52/391 |
| 6,371,584 | B1 * | 4/2002 | Alreck | A47B 67/04 312/235.1 |
| 6,722,749 | B1 | 4/2004 | Pagac | |
| 8,282,177 | B1 | 10/2012 | Rotter | |
| 8,376,481 | B2 | 2/2013 | Lee | |
| 9,377,238 | B2 | 6/2016 | Hall et al. | |
| 9,982,937 | B2 | 5/2018 | Tierney et al. | |
| 10,786,080 | B1 * | 9/2020 | Stravitz | A47B 97/00 |
| 2003/0201700 | A1 | 10/2003 | Cho | |
| 2004/0031705 | A1 | 2/2004 | DeTemple, II et al. | |
| 2004/0046488 | A1 | 3/2004 | Hogan | |
| 2004/0056573 | A1 | 3/2004 | Chae | |
| 2006/0042306 | A1 * | 3/2006 | Choi | F25D 23/00 62/407 |
| 2006/0087208 | A1 | 4/2006 | Oh et al. | |
| 2006/0248916 | A1 | 11/2006 | Kim et al. | |
| 2006/0250062 | A1 | 11/2006 | Janda et al. | |
| 2007/0262686 | A1 | 11/2007 | Ji | |
| 2009/0045713 | A1 | 2/2009 | Kunkle et al. | |
| 2009/0160298 | A1 | 6/2009 | Chen et al. | |
| 2009/0277210 | A1 * | 11/2009 | Eveland | F25D 23/028 62/441 |
| 2010/0192621 | A1 | 8/2010 | Kim | |
| 2010/0236279 | A1 | 9/2010 | Eom et al. | |
| 2010/0239795 | A1 * | 9/2010 | Gat | A47B 96/202 428/34.1 |
| 2010/0283365 | A1 | 11/2010 | Chen | |
| 2011/0050065 | A1 | 3/2011 | Lee et al. | |
| 2011/0050066 | A1 | 3/2011 | Lee et al. | |
| 2011/0162402 | A1 | 7/2011 | Park | |
| 2012/0091872 | A1 | 4/2012 | Matthes et al. | |
| 2012/0125035 | A1 | 5/2012 | Chellappan et al. | |
| 2012/0306338 | A1 | 12/2012 | Nagahata et al. | |
| 2013/0129267 | A1 | 5/2013 | Chen | |
| 2013/0264928 | A1 | 10/2013 | Hong et al. | |
| 2013/0270986 | A1 | 10/2013 | Min et al. | |
| 2013/0270987 | A1 | 10/2013 | Kelly | |
| 2013/0270989 | A1 | 10/2013 | Park et al. | |
| 2014/0265783 | A1 | 9/2014 | Hauer et al. | |
| 2014/0319990 | A1 | 10/2014 | Gephart et al. | |
| 2015/0059398 | A1 | 3/2015 | Yoo et al. | |
| 2015/0059399 | A1 | 3/2015 | Hwang et al. | |
| 2015/0184918 | A1 | 7/2015 | Klingshirn et al. | |
| 2016/0146533 | A1 | 5/2016 | Jung | |
| 2016/0153704 | A1 | 6/2016 | Burke et al. | |
| 2016/0178274 | A1 | 6/2016 | Shin | |
| 2016/0265816 | A1 * | 9/2016 | Gillette | F25D 25/025 |
| 2016/0305705 | A1 * | 10/2016 | Dubina | F25D 23/021 |
| 2016/0320118 | A1 | 11/2016 | Millett | |
| 2016/0370063 | A1 | 12/2016 | Yang | |
| 2017/0051967 | A1 | 2/2017 | Tierney et al. | |
| 2017/0227279 | A1 * | 8/2017 | Yang | F25D 23/028 |
| 2017/0336129 | A1 | 11/2017 | Cunningham | |
| 2017/0362864 | A1 | 12/2017 | Fazi et al. | |
| 2018/0283771 | A1 | 10/2018 | Shin et al. | |
| 2019/0219324 | A1 | 7/2019 | Kang | |
| 2019/0293341 | A1 | 9/2019 | Yeom | |
| 2019/0390895 | A1 * | 12/2019 | Choi | F25D 25/022 |
| 2020/0011593 | A1 * | 1/2020 | Ji | F25D 25/025 |
| 2020/0072533 | A1 | 3/2020 | Cho | |

FOREIGN PATENT DOCUMENTS

| | | | |
|---|---|---|---|
| CN | 204902419 | | 12/2015 |
| CN | 107388718 | | 11/2017 |
| CN | 109028726 | | 12/2018 |
| CN | 208640001 | | 3/2019 |
| CN | 208736030 | | 4/2019 |
| CN | 109838961 | | 6/2019 |
| DE | 29620152 | | 4/1997 |
| DE | 10-2005-016418 | | 11/2005 |
| EP | 1 724 540 | | 11/2006 |
| EP | 2 299 215 | | 3/2011 |
| EP | 3 023 721 | | 5/2016 |
| EP | 3 505 854 | | 7/2019 |
| EP | 3 546 862 | | 10/2019 |
| EP | 3 617 630 | | 3/2020 |
| GB | 2108564 | | 5/1983 |
| JP | H04-138331 | | 12/1992 |
| JP | H 08-303944 | | 11/1996 |
| JP | H08-303944 | | 11/1996 |
| JP | 2001-280824 | | 10/2001 |
| JP | 2002-264943 | | 9/2002 |
| KR | 10-2006-0027592 | | 3/2006 |
| KR | 10-2006-0053420 | | 5/2006 |
| KR | 10-2007-0075671 | | 7/2007 |
| KR | 10-2008-0101335 | | 11/2008 |
| KR | 10-2009-0027111 | | 3/2009 |
| KR | 10-2009-0102576 | | 9/2009 |
| KR | 10-2009-0102577 | | 9/2009 |
| KR | 10-0921380 | | 10/2009 |
| KR | 10-2009-0114265 | | 11/2009 |
| KR | 10-2010-0012544 | | 2/2010 |
| KR | 10-0946784 | | 3/2010 |
| KR | 10-2011-0015331 | | 2/2011 |
| KR | 20-0460442 | | 6/2012 |
| KR | 10-2013-0071919 | | 7/2013 |
| KR | 10-2014-0037474 | | 3/2014 |
| KR | 10-2018-0138083 | | 12/2018 |
| KR | 10-2018-0138085 | | 12/2018 |
| KR | 10-2019-0081331 | | 7/2019 |
| WO | 92/14522 | * | 9/1992 |
| WO | WO 03/016661 | | 2/2003 |
| WO | WO 2018/051963 | | 3/2018 |

OTHER PUBLICATIONS

European Search Report dated Mar. 17, 2020 issued in Application No. 19199553.9.

European Search Report dated Mar. 20, 2020 issued in Application No. 19199569.5.

European Search Report dated Mar. 30, 2020 issued in Application No. 19199556.2.

European Search Report dated Apr. 3, 2020 issued in Application No. 19199625.5.

European Search Report dated Apr. 6, 2020 issued in Application No. 19199587.7.

European Search Report dated Apr. 6, 2020 issued in Application No. 19199629.7.

European Search Report dated Apr. 7, 2020 issued in Application No. 19199607.3.

United States Office Action dated Mar. 4, 2020 issued in U.S. Appl. No. 16/582,712.

United States Office Action dated Mar. 9, 2020 issued in U.S. Appl. No. 16/582,810.

European Search Report dated Apr. 1, 2020 issued in EP Application No. 19199637.0.

European Search Report dated Mar. 23, 2020 issued in EP Application No. 19199602.4.

European Search Report dated Aug. 14, 2020 issued in EP Application No. 19199647.9.

U.S. Appl. No. 16/583,726, filed Sep. 26, 2019.

U.S. Appl. No. 16/582,647, filed Sep. 25, 2019.

U.S. Appl. No. 16/582,518, filed Sep. 25, 2019.

U.S. Appl. No. 16/582,605, filed Sep. 25, 2019.

U.S. Appl. No. 16/582,712, filed Sep. 25, 2019.

U.S. Appl. No. 16/582,756, filed Sep. 25, 2019.

U.S. Appl. No. 16/582,668, filed Sep. 25, 2019.

U.S. Appl. No. 16/582,755, filed Sep. 25, 2019.

U.S. Appl. No. 16/582,831, filed Sep. 25, 2019.

U.S. Appl. No. 16/585,284, filed Sep. 27, 2019.

U.S. Appl. No. 16/585,301, filed Sep. 27, 2019.

U.S. Appl. No. 16/585,816, filed Sep. 27, 2019.

European Office Action dated Sep. 30, 2020 issued in EP Application No. 19199556.2.

(56) References Cited

OTHER PUBLICATIONS

European Communication dated Feb. 8, 2021 issued in Application 19 199 627.1.

* cited by examiner

REFRIGERATOR

CROSS-REFERENCE TO RELATED APPLICATION

The present application claims priority to Korean Patent Application No. 10-2019-0084453, filed Jul. 12, 2019 in Korea, the entire contents of which is incorporated herein for all purposes by this reference.

BACKGROUND

1. Field

The present disclosure relates to a refrigerator having a drawer.

2. Background

A refrigerator is a home appliance that is provided to store various foods or beverages for a long time by cold air generated by circulation of a refrigerant according to a refrigeration cycle.

The refrigerator may be divided into two types of refrigerators: a common refrigerator that can store storage items a user wants to store regardless of a type of food or drink; and an exclusive-use refrigerator that varies in size or function based on a type of storage item to be stored.

The exclusive use refrigerator may include a kimchi refrigerator, a wine refrigerator, and so on.

The refrigerator may be classified into various types depending on a door opening and closing method of a storage chamber in a cabinet, such as a swinging door-type refrigerator, a drawer-type refrigerator, and a hybrid-type refrigerator having both doors and drawers. The hybrid-type refrigerator has a structure in which a swinging door is provided in an upper portion of the cabinet and a drawer is provided in a lower portion thereof.

The drawer provided in the drawer refrigerator or the hybrid-type refrigerator may open, by a user's operation, from an inside space of the cabinet in a sliding manner. The drawer may close by being pushed into the inside space of the cabinet by user's pushing operation, thereby allowing an open front portion of the cabinet to be closed.

The drawer may include a front panel and a storage bin (or storage room), the front panel forming a front surface of the refrigerator and being moved forward and rearward, thereby allowing the inside space of the cabinet to be opened/closed and the storage bin being provided in rear of the front panel and received in the inside space of the cabinet. By pulling the front panel, the storage bin may open from the inside space of the cabinet, thus various foods can be stored in and taken out from the storage bin.

The drawer provided in the drawer refrigerator or the hybrid-type refrigerator is mainly provided in the lower portion of the cabinet. This is because, due to weight of storage items stored in the storage room of the drawer, the drawer may be removed from the cabinet and fall down when the drawer is opened.

However, when the drawer is provided in the lower portion of the cabinet, the user should bend over at the waist while keeping away from the front panel by an appropriate distance for opening of the drawer.

Korean Patent Application Publication No. 10-2009-0102577, Korean Patent Application Publication No. 10-2009-0102576, Korean Patent Application Publication No. 10-2013-0071919, and Korean Patent Application Publication No. 10-2018-0138083, the subject matters of which are incorporated herein by reference, may disclose features of a refrigerator in which a drawer may be automatically opened.

However, the automatic opening technology, an operation error may occur in that the drawer may be automatically opened regardless of user's intention.

That is, since the automatic drawer is controlled to detect proximity of the user or to be automatically opened by touch (or pressing) of a designated button, the operation error may occur due to various situations.

Accordingly, when the drawer is opened due to operation error and the user is in front of the drawer, the drawer may fall downward due to the door's weight and hit a user's instep, thus causing a safety accident.

BRIEF DESCRIPTION OF THE DRAWINGS

Arrangements and embodiments may be described in detail with reference to the following drawings in which like reference numerals refer to like elements, and wherein.

DETAILED DESCRIPTION

An exemplary embodiment with respect to a refrigerator of the present disclosure may be described in detail with reference to accompanying FIGS. 1 to 43.

Figure 1:
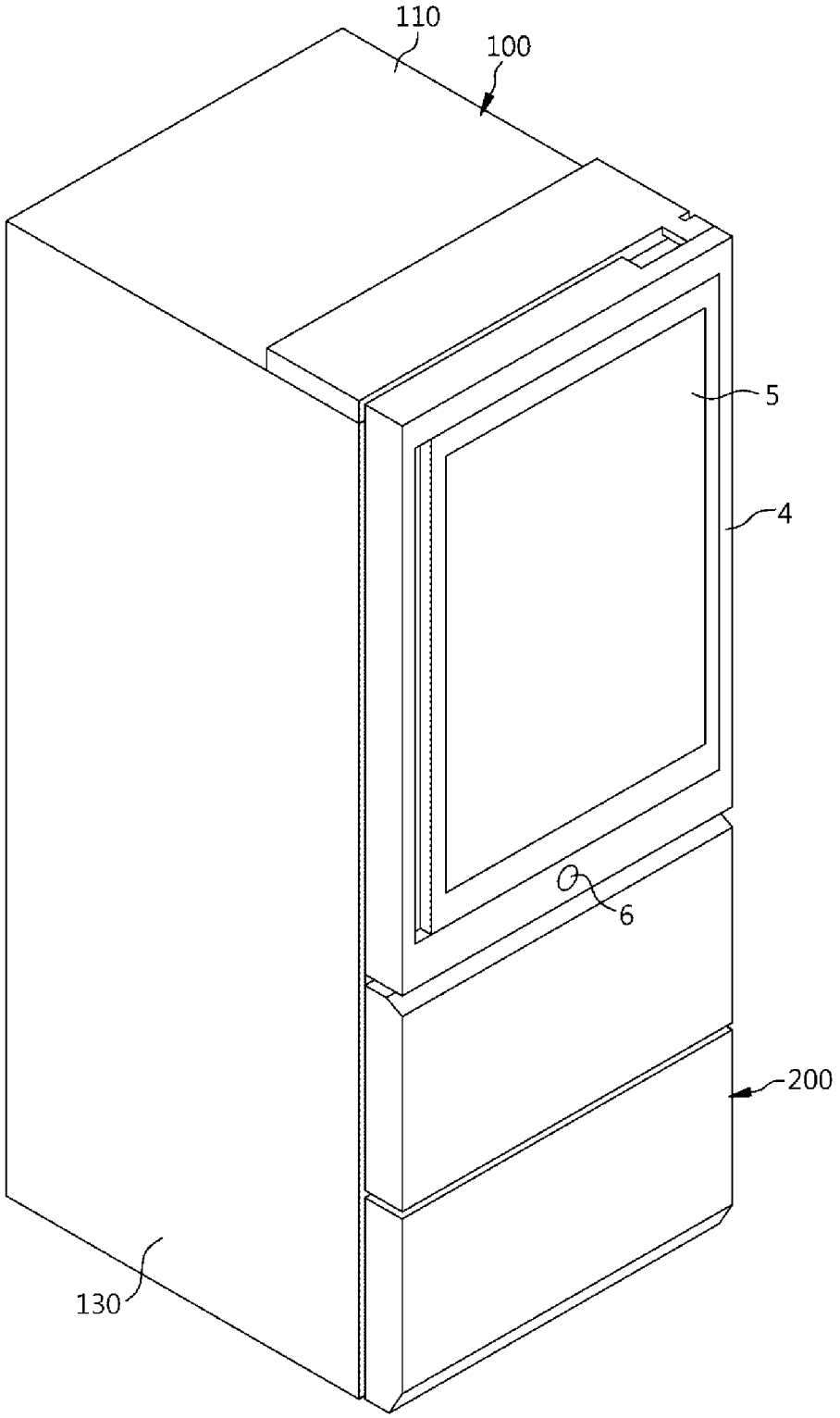
FIG. 1 is a perspective view showing a refrigerator according to an embodiment of the present disclosure.
Figure 2:
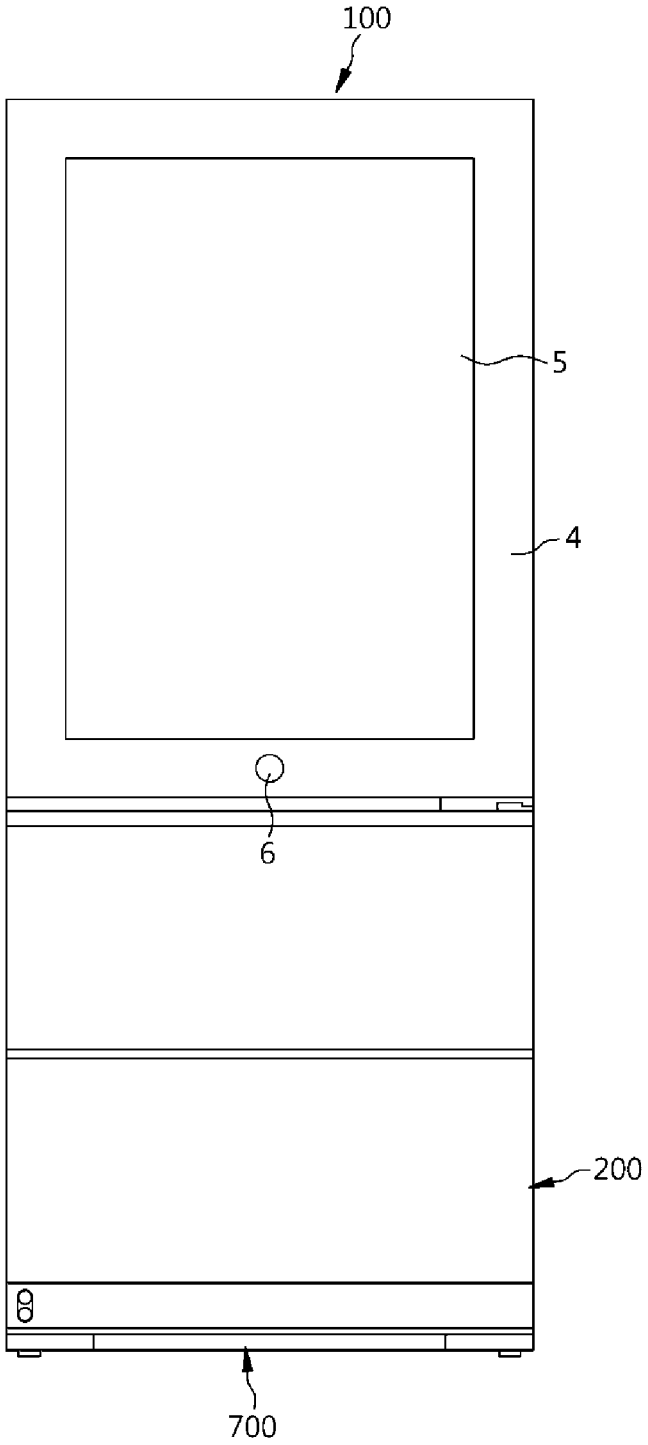
FIG. 2 is a front view showing the refrigerator according to the embodiment of the present disclosure.
Figure 3:
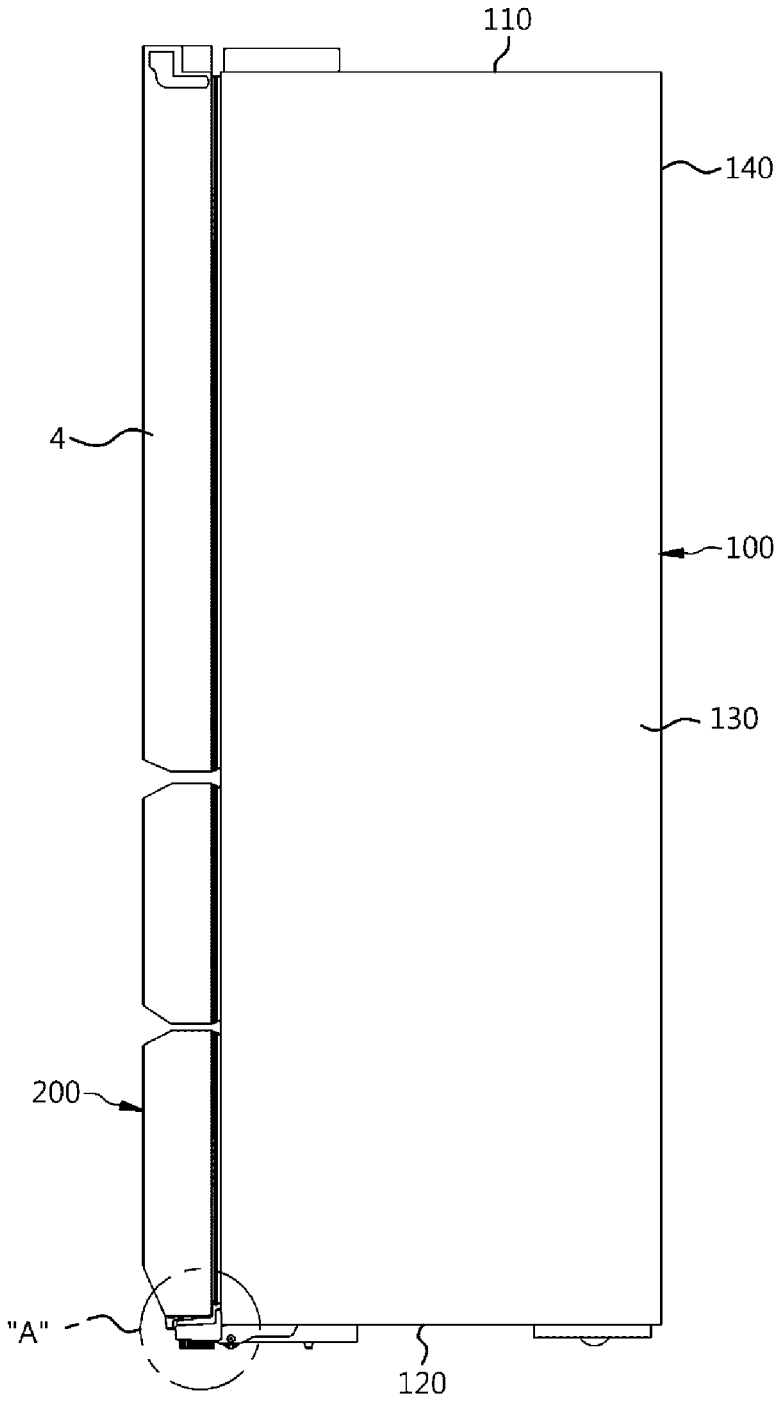
FIG. 3 is a side view showing the refrigerator according to the embodiment of the present disclosure.
Figure 4:
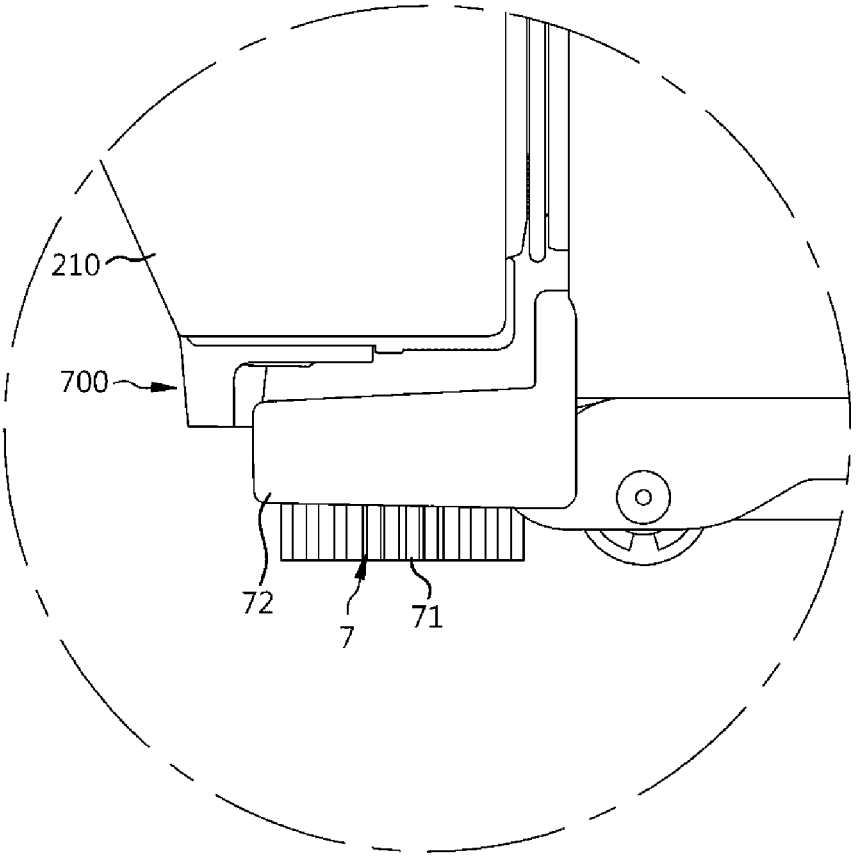
FIG. 4 is an enlarged view of "A" part in FIG. 3.

FIG. 1 is a perspective view showing a refrigerator in which a shock absorption module according to an embodiment of the present disclosure is installed. FIG. 2 is a front view showing the refrigerator in which a shock absorption module according to an embodiment of the present disclosure is installed. FIG. 3 is a side view showing the refrigerator in which a shock absorption module according to an embodiment of the present disclosure is installed.

As shown in the drawings, a refrigerator according to example embodiments of the present disclosure may include a cabinet 100, a drawer 200, and a shock absorption module 700 (referring to FIG. 2) (or shock absorption device). The shock absorption module 700 may be provided on a lower surface of a front panel 210 constituting the drawer 200 to absorb a shock generated by a hitting on a floor when the drawer 200 is opened.

The cabinet 100 may constitute an outer appearance of the refrigerator.

The cabinet 100 may include an upper wall or a roof 110 forming an upper side wall, a lower wall or a bottom 120 forming a lower side wall, two side walls 130 forming opposite side walls, and a rear wall 140 forming a rear side wall, and the cabinet may be configured as a box-shaped body which is opened forward. An inside space of the cabinet 100 may be used as a storage space.

Figure 5:
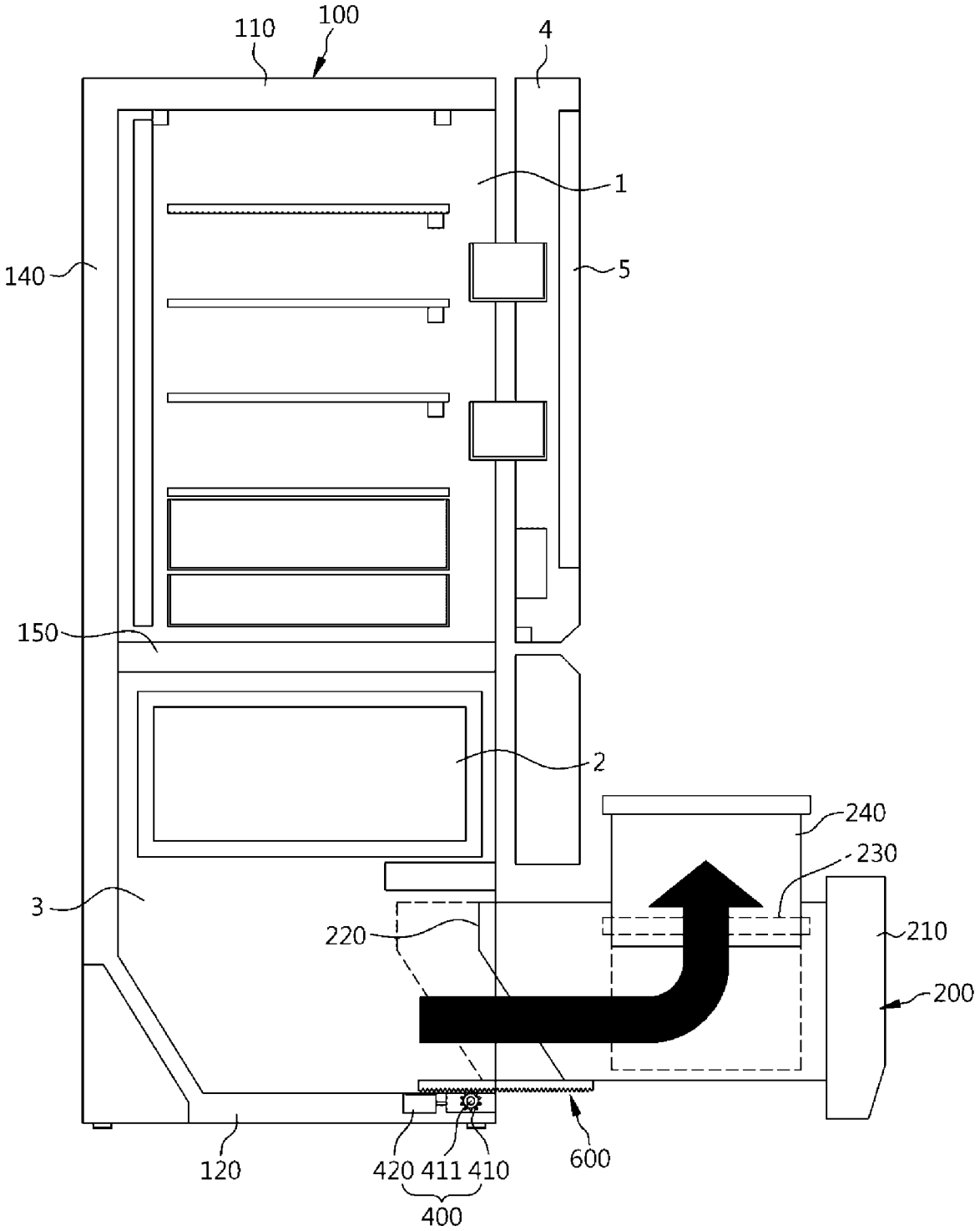
FIG. 5 is a view showing an inner structure of the refrigerator according to the embodiment of the present disclosure.

A plurality of partition walls 150 may be provided inside the cabinet 100. The partition walls 150 may divide the storage space in the cabinet 100 into a plurality of spaces, so that the storage space is provided as a plurality of vertically partitioned storage chambers (1, 2, and 3), as shown in FIG. 5.

In other implementations, the partition walls 150 may extend vertically partition the storage space in the cabinet 100 into storage chambers that are horizontally positioned.

The refrigerator according to an embodiment of the present disclosure is provided with three storage chambers partitioned up and down. An upper storage chamber 1 may be a refrigerator chamber, and a center storage chamber 2 and a lower storage chamber 3 may be a refrigerator chamber or a freezer chamber, or a separate space.

Each storage chambers (1, 2, and 3) of the cabinet 100 is configured to be separately opened and closed by a door thereof. The upper storage chamber 1 may be opened and closed by a swinging door 4, and the center storage chamber 2 and the lower storage chamber 3 may be opened and closed by the drawer 200. The center storage chamber 2 may be configured to be opened and closed by the swinging door 4.

The swinging door 4 may be hingedly coupled to the cabinet 100 in a swinging manner, and the swinging door 4 may rotate to open or close an opening to the upper storage chamber 1.

A display part 5 (or display) may be provided on a front surface of the swinging door 4 for outputting information. A variety of different information such as an operational state of the refrigerator or temperatures of each storage chamber (1, 2, and 3) may be displayed on the display part 5.

The display part 5 may include at least one of an LCD, LED, and so on.

The drawer 200 may open and close in a sliding manner. In an embodiment, the drawer 200 may be provided at the lower storage chamber 3 and may open in a drawer manner.

The drawer 200 may include the front panel 210 and a storage bin 220 (or storage room).

The front panel 210 may be pushed into the storage chamber so that the open front of the lower storage chamber 3 is closed and shielded, and the front panel 210 may have an installation space therein.

The front panel 210 may be formed such that a metal thin plate is folded into multiple stages so as to have each wall surface (upper surface, opposite side surfaces, front surface, and lower surface). The front panel 210 may be provided with an inner frame 211 (referring to FIG. 31) therein, the inner frame 211 being formed of resin for reducing a weight of the front panel and improving productivity thereof. The front panel 210 may be formed of a material having metal texture.

The storage bin 220 may be provided at a rear of the front panel 210 and is received in the lower storage chamber 3.

The storage bin 220 may be formed in a box-shaped body that is open upward, and a front surface of the storage bin 220 may be fixed to a rear surface of the front panel 210 in a close contact state therewith. The storage bin 220 and the front panel 210 may be coupled to each other by hooking or bolting, screwing, gearing, fitting, and so on.

Guide rails 230 may be respectively provided on opposite outside walls of the storage bin 220 and on opposite inner side walls of the lower storage chamber 3. The inner side walls of the lower storage chamber 3 may face the outer side walls of the storage bin 220. The guide rails of the storage bin 220 and the guide rails of the lower storage chamber 3 are engaged with each other and support forward and rearward movement of the storage bin 220.

Although not shown, the guide rails 230 may be respectively provided on a lower surface of the storage bin 220 and a bottom surface in the lower storage chamber 3, and the guide rails may be engaged with each other, where the bottom surface in the lower storage chamber 3 face the lower surface of the storage bin 220. The guide rails 230 may also be configured to extend into multiple stages.

A separate container 240 may be provided in the storage bin 220. That is, a variety of food may be stored in the storage bin 220, but the container 240 is in the storage bin 220 so that the food may be stored in the container 240. The container 240 may be a kimchi container or a basket to open upward.

When the storage bin 220 is pushed out from the lower storage chamber 3, the container 240 may move upward in the storage bin 220.

In order for a user to raise the container 240 in the storage bin 220, it is necessary to form a gap in which fingers of the user are inserted between the storage bin 220 and the container 240, so a size of the container 240 should be reduced by a size of the gap. Accordingly, the container 240 may be automatically separated from the storage bin 220 in order that the size of the container 240 is maximized. When the container 240 is automatically separated from the storage bin 220, the user can easily take out the container 240.

Figure 6:
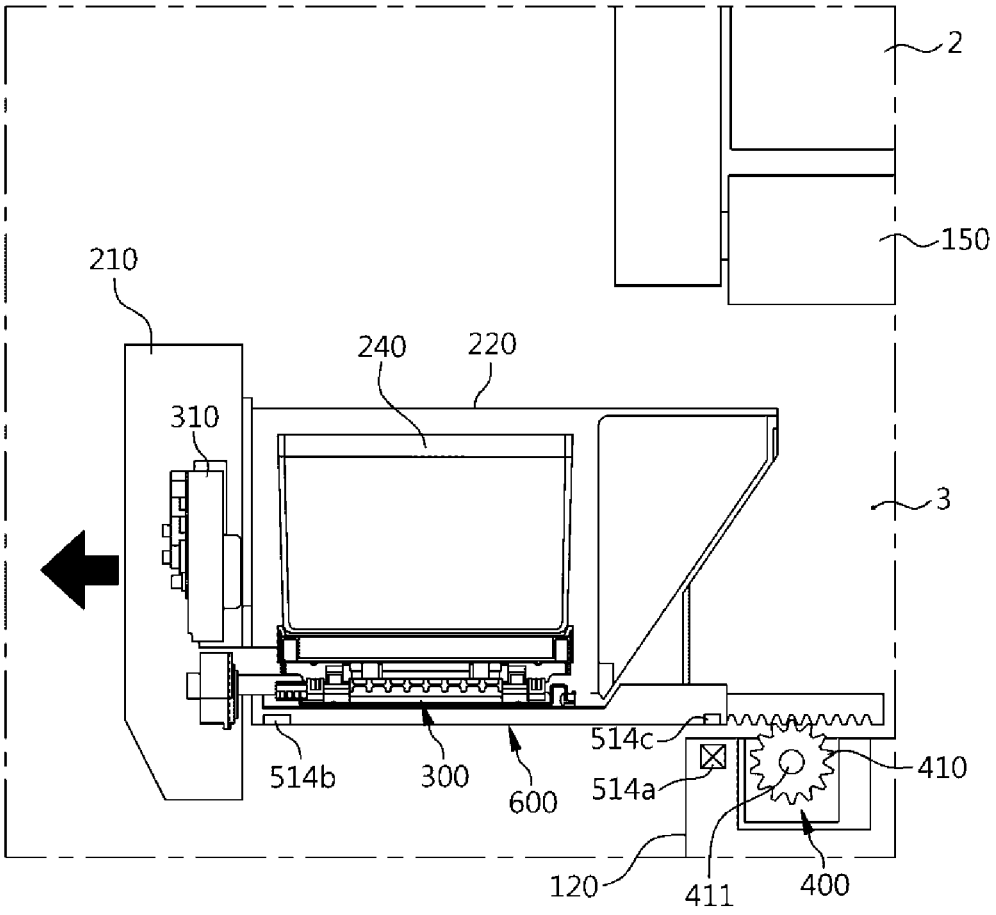
FIG. 6 is a main part view showing schematically the refrigerator according to the embodiment of the present disclosure, wherein a drawer of the refrigerator is opened.
Figure 7:
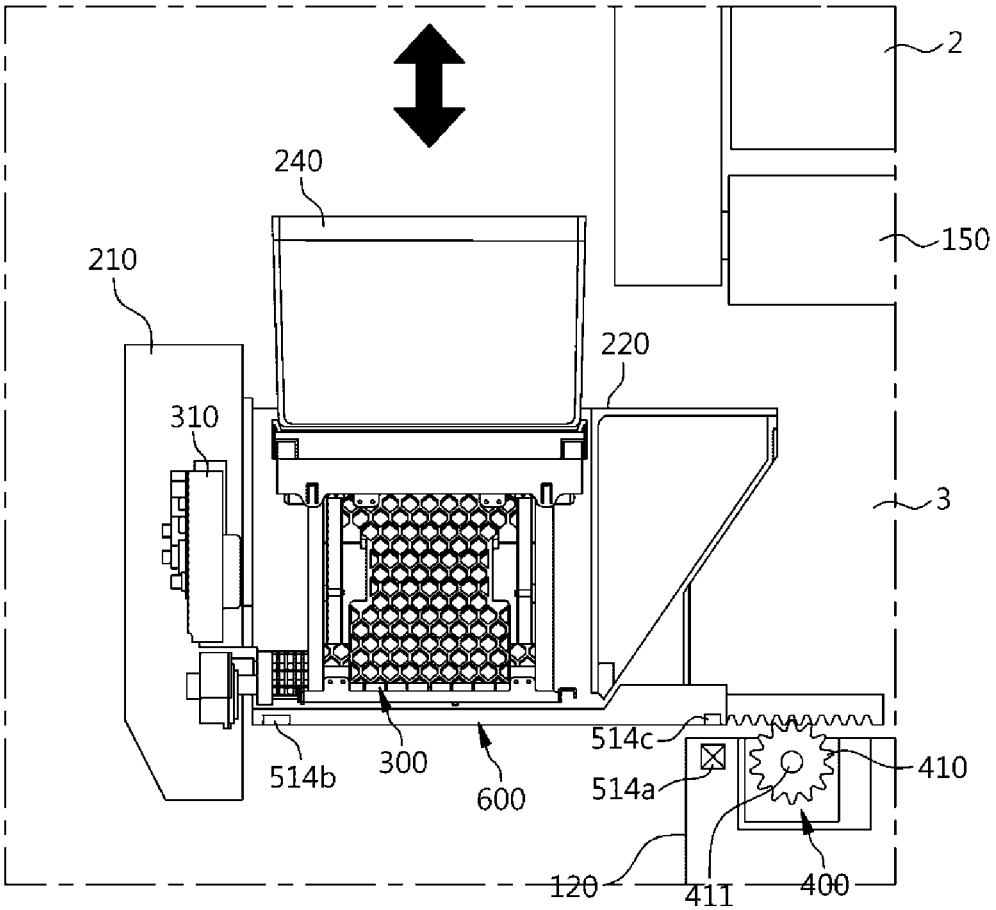
FIG. 7 is a main part view showing schematically the refrigerator according to the embodiment of the present disclosure, wherein a container is raised upward when the drawer of the refrigerator is opened.
Figure 8:
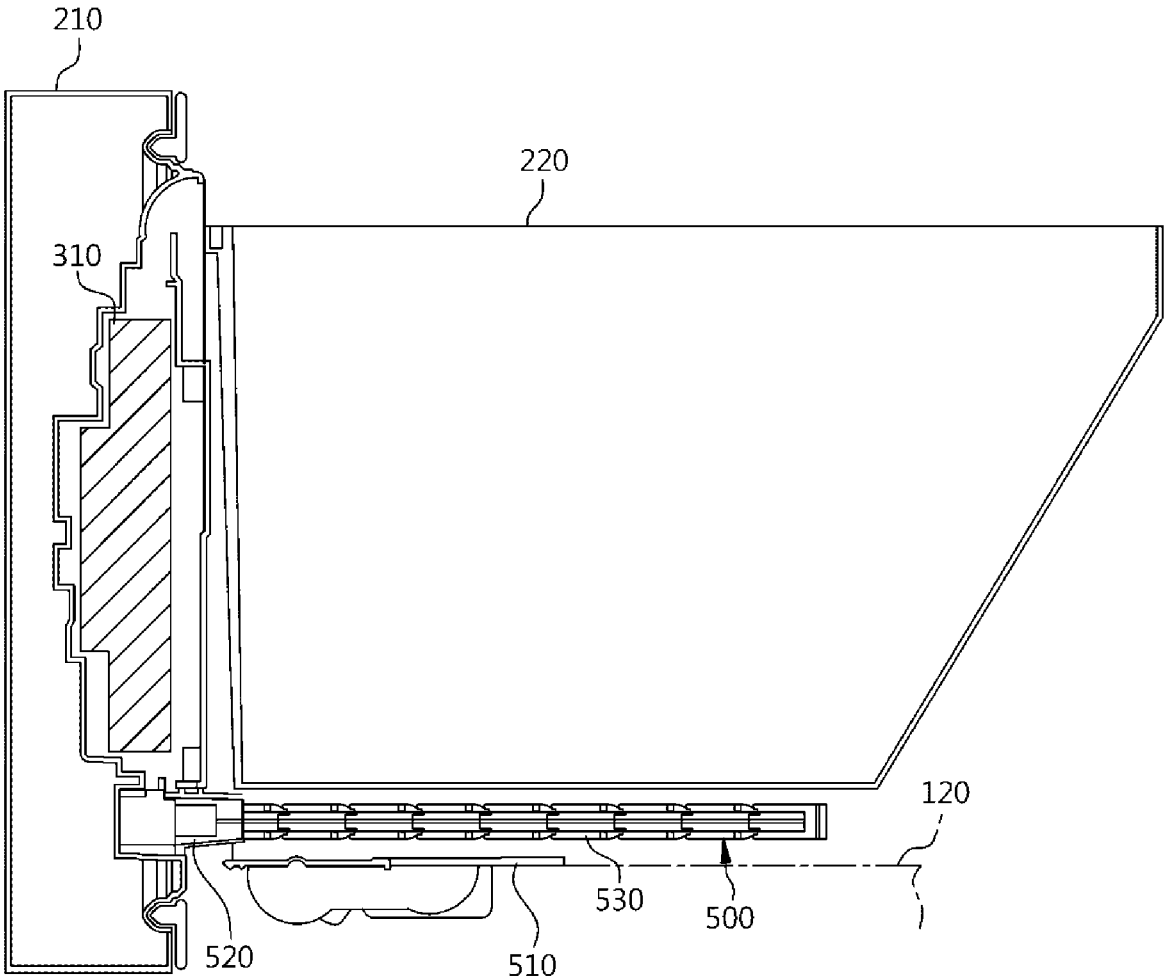
FIG. 8 is a side view showing the drawer of the refrigerator according to the embodiment of the present disclosure, the drawer being equipped with a cable guide module.
Figure 9:
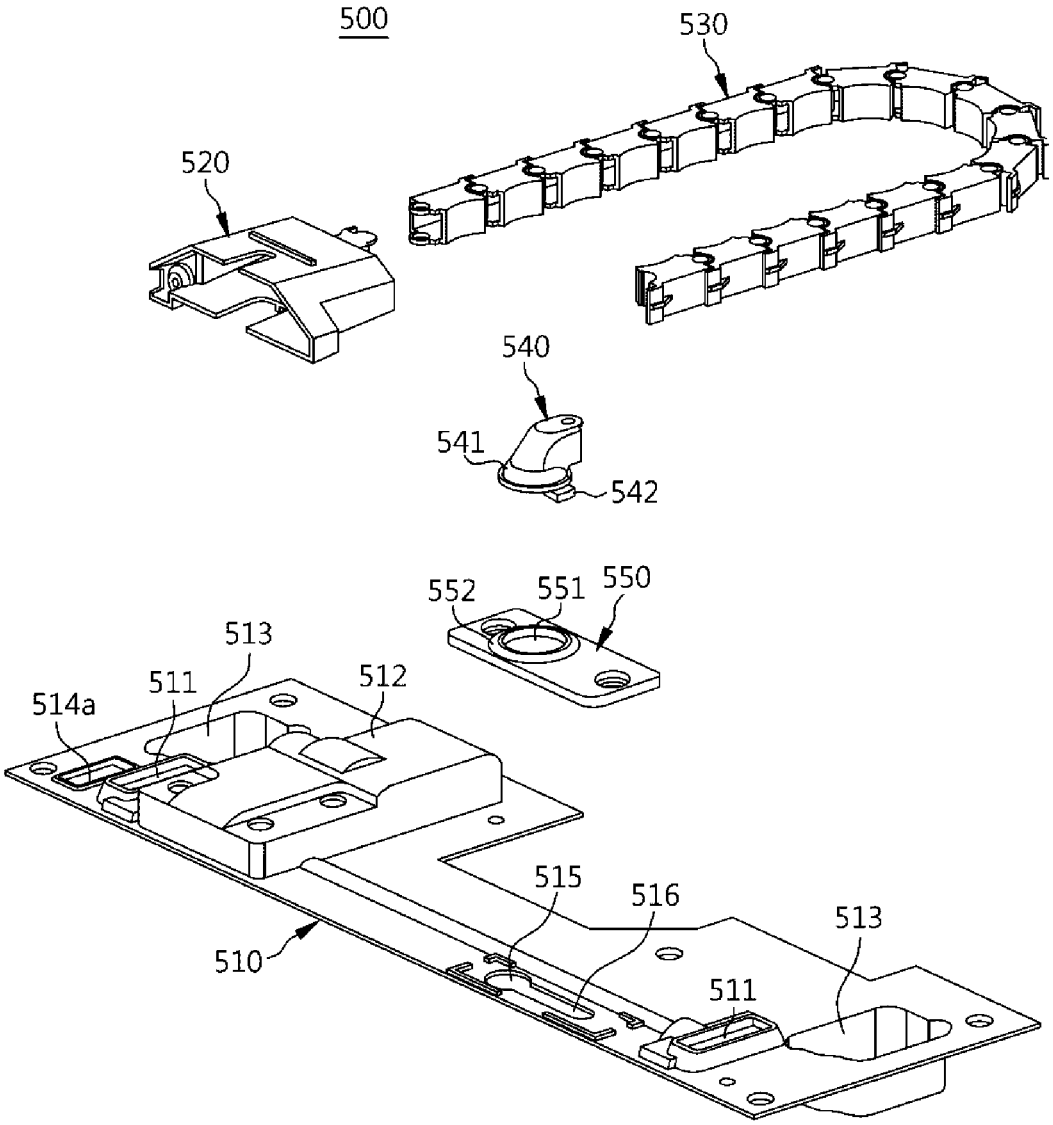
FIG. 9 is an exploded-perspective view showing the cable guide module of the refrigerator according to the embodiment of the present disclosure.
Figure 10:
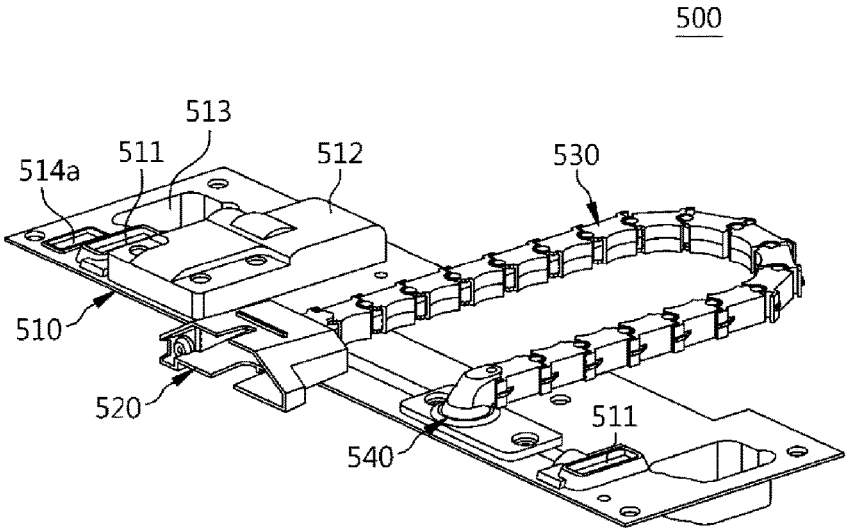
FIG. 10 is a perspective view showing a coupled state of the cable guide module of the refrigerator according to the embodiment of the present disclosure.

A raising/lowering module 300 (or lift module) may be provided in the storage bin 220 to automatically raise the container 240, as shown in FIGS. 5 and 6.

The raising/lowering module 300 may be embodied in various forms. For example, the raising/lowering module 300 may be formed in a scissors linkage structure such that when the raising/lowering module 300 is folded, a height is minimized, and when the raising/lowering module 300 is unfolded, the height is maximized.

Electrical parts 310 (for example, drive motor, etc.) supplying a driving force for raising movement of the raising/lowering module 300 may be provided in the installation space in the front panel 210.

When the raising/lowering module 300 is operated before the storage bin 220 of the drawer 200 is fully pushed out, the container 240 or the cabinet 100 may be broke. Therefore, a control program may be is programmed to operate the raising/lowering module only when the storage bin 220 is fully pushed out, and the control program being programmed to control movement of the raising/lowering module 300.

The driving part 400 (or driving device) may provide a driving force for forward and rearward movement of the drawer 200.

The driving part 400 may be provided on the bottom 120 of the cabinet 100, and may include a pinion 410 and a driving motor 420.

The pinion 410 may penetrate partially through the bottom surface (upper surface of the bottom) in the lower storage chamber 3 and may be exposed to the inside of the lower storage chamber 3. The driving motor 420 may supply power to the pinion 410 while being fixed in the bottom 120 of the cabinet 100.

Figure 11:
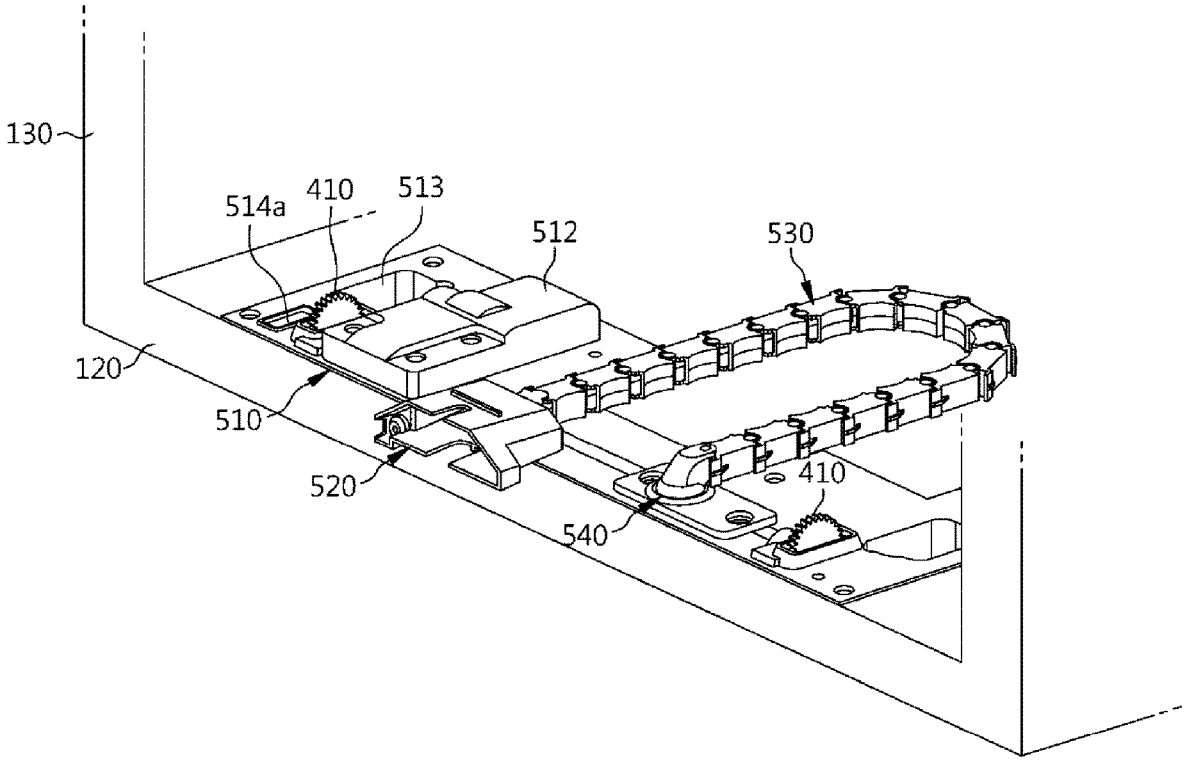
FIG. 11 is a perspective view showing an installation state of the cable guide module, the cable guide module of the refrigerator according to the embodiment of the present disclosure being installed in a storage chamber.
Figure 12:
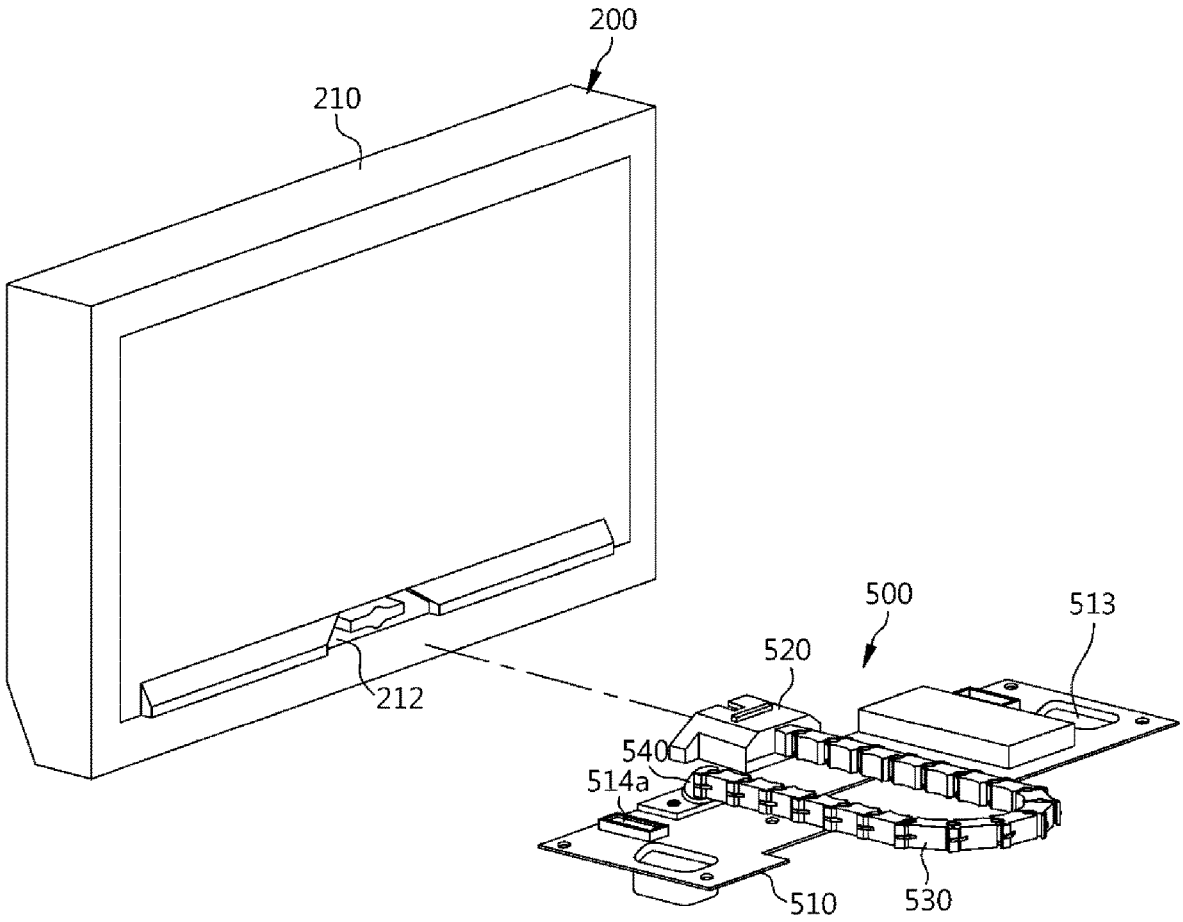
FIG. 12 is a perspective view showing the drawer taken at the rear side, wherein the cable guide module of the refrigerator according to the embodiment of the present disclosure is connected to the drawer.

In an embodiment of the present disclosure, two pinions 410 may be respectively provided one by one on opposite sides of the bottom surface in the lower storage chamber 3 (referring to FIG. 11). The two pinions 410 may be connected to each other by a power transmission shaft 411. The driving motor 420 may be connected to the power transmission shaft 411 by a belt, a chain, or a gear for supplying power thereto.

By the driving of the driving motor 420, the two pinions 410 may rotate at the same time with the same speed and direction.

A reduction gear may be provided in a connecting portion between the power transmission shaft 411 and the driving motor 420.

The two pinions 410 may be positioned at foremost sides of the bottom surface in the lower storage chamber 3. Thus, the drawer 200 may open to the maximum.

The driving motor 420 may operate when proximity of the user is sensed, and/or may operate when a button 6 is manipulated by the user.

The button 6 may be a touch-type button provided on the display part 5 of the swinging door 4. The button 6 may also be a pressure-type button provided on a separate position from the display part 5.

A cable guide module 500 (or cable guide device) may be connected to the bottom surface (upper surface of the bottom) in the lower storage chamber 3 and to the front panel 210.

The cable guide module 500 may protect a power line and cables (hereinafter referred to as cables), which are connected to the electrical parts in the front panel 210 among various power lines and cables connected along the inside of the bottom 120.

The cable guide module 500 is configured to guide the cables to be moved with forward and rearward movement of the drawer 200, and to prevent the cables from being damaged by twisting and scraping.

The cable guide module 500 may include a cover plate 510, a guiding head 520, a plurality of connecting members 530 (or connecting segments), a swinging connection member 540 (or swinging connection base), and a mounting plate 550, as shown in FIGS. 9 to 12.

The cable guide module 500 may be described in detail on a per component basis.

The cover plate 510 (of the cable guide module 500) may be coupled to the upper surface of the bottom 120.

A part of a front upper surface of the bottom 120 may be formed to be open, and the cover plate 510 may be coupled to the bottom 120 and cover the open part thereof.

Two pinion exposure holes 511 may be respectively provided on opposite sides of the cover plate 510 in a penetrating manner so that the pinions 410 of the driving part 400 are exposed.

The cover plate 510 may include a motor receiving part 512 that receives the driving motor 420 (included in the driving part 400). The motor receiving part 512 may protrude from a part of the cover plate 510 that protrudes upward, or may be formed separately from the cover plate 510 and then coupled to the cover plate 510. The motor receiving part 512 may be formed in different forms or manners.

Two protrusion passing holes 513 may be respectively formed through opposite sides in the rear of the cover plate 510, and each protrusion passing holes 513 may be for installation of a confining protrusion part 650, which may be described below. An upper end of the confining protrusion part 650 may be exposed toward the inside of the lower storage chamber 3 while the confining protrusion part 650 may be accommodated in the protrusion passing hole 513. The confining protrusion part 650 may be described below in a description about a rack gear assembly 600.

An open/close sensing part 514 may be provided at any one side of the cover plate 510 to sense opening and closing of the drawer 200. The open/close sensing part 514 may be a hall sensor. A magnet may be provided on the lower surface of the storage bin 220, and the magnet being sensed by the hall sensor. The open/close sensing part 514 may be provided as various structures such as an optical sensor, a switch, and so on, and a position of the sensing part 514 may be provided where the cabinet 100 and the drawer 200 face each other.

The guiding head 520 (of the cable guide module 500) may be coupled to the front panel 210.

An installation hole 212 may be provided on a center lower portion of the rear surface of the front panel 210. The guiding head 520 may pass partially into the installation hole 212 and is coupled to the rear surface of the front panel 210.

Each of the connecting members 530 (of the cable guide module 500) connects the swinging connection member 540 and the guiding head 520 to be moveable.

The connecting member 530 may be configured as a hollow tubular body and is connected to another connecting member 530 continuously. The cables may sequentially pass inside the connecting members 530 in order. The connection structure of the connecting member 530 may be a chain linkage structure.

A connected portion between each of the connecting members 530 may be provided to swing in a horizontal direction. A first end of the connecting member 530 may be connected to the swinging connection member 540 in a swinging manner, and a second end of the connecting member 530 may be connected to the guiding head 520 in a swinging manner. Through the structure, when the drawer 200 is moved forward and rearward, the connecting members 530 may move in conjunction with movement of the drawer 200 to move the cables.

The swinging connection member 540 (of the cable guide module 500) may be rotatably connected to the cover plate 510.

A cable through-hole 515 may be provided on the cover plate 510 so that the cables pass therethrough, and the swinging connection member 540 may have a pipe structure and one end thereof is in close contact with an upper surface of the cover plate 510. On the end of the swinging connection member 540, an extension end 541 may have a dome structure extending gradually toward the end.

An extension hole 516 may be provided on a circumference of the cable through-hole 515 at a predetermined position. On a circumference of the extension end 541 constituting the swinging connection member 540, a confining protrusion 542 may protrude outwards and pass through the extension hole 516.

The extension hole 516 may have a width through which only the confining protrusion 542 may pass. That is, as the confining protrusion 542 passes through the extension hole 516 and then a manipulation in which the swinging connection member 540 is partially rotated is performed, the swinging connection member 540 may be maintained in a state of preventing separation from the cable through-hole 515 of the cover plate 510.

The mounting plate 550 (of the cable guide module 500) may be provided to prevent the swinging connection member 540 connected to the cover plate 510 from being separated from the cover plate 510.

The mounting plate 550 may be fixedly coupled to the cover plate 510, and provided with a communicating hole 551 and a covering end 552. The communicating hole 551 is provided on a portion corresponding to the cable through-hole 515, and with the covering end 552 protruding from a circumference of the communicating hole 551 to cover the extension end 541 of the swinging connection member 540. An inner surface of the covering end 552 may have the same spherical surface as an outer surface of the extension end 541 so that the covering end 552 and the extension end 541 are in close contact with each other.

The drawer 200 of the refrigerator may be provided with the rack gear assembly 600.

Since the rack gear assembly 600 is provided in the drawer 200, the drawer 200 may move forward and rearward by a driving force of the driving part 400 provided in the cabinet 100.

Figure 13:
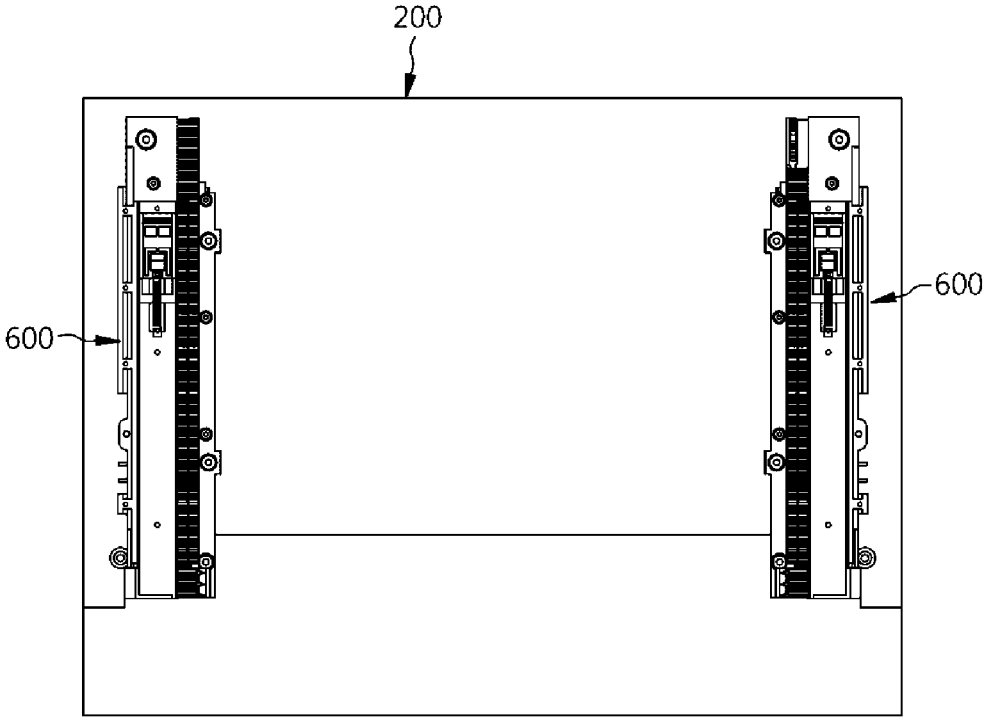
FIG. 13 is a bottom view of the refrigerator showing a state in which a rack gear assembly is installed therein.
Figure 14:
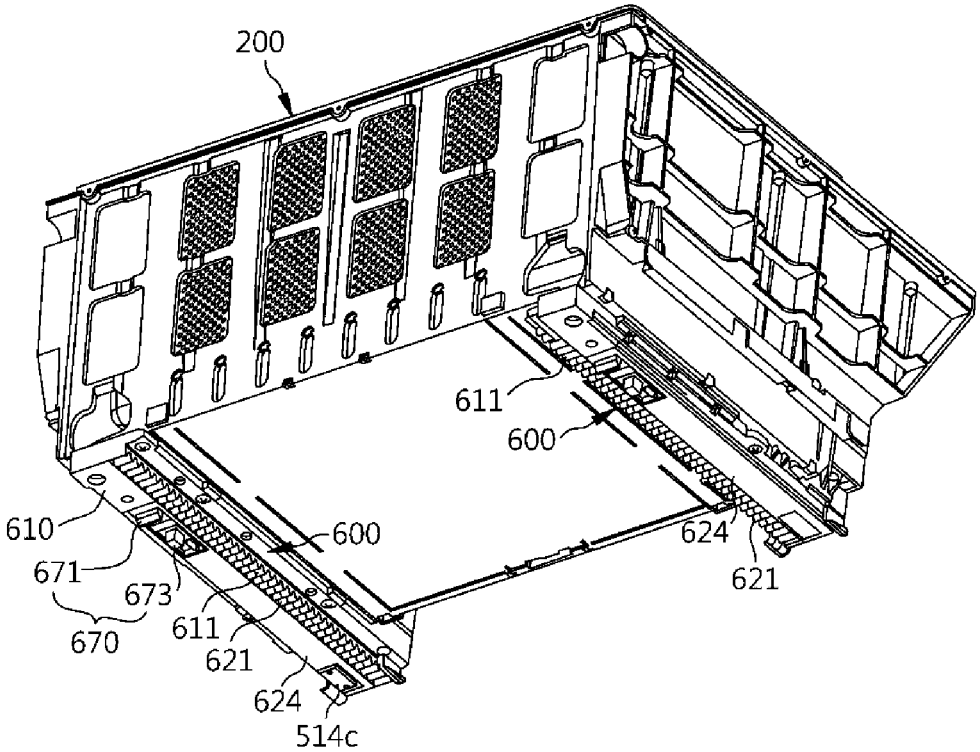
FIG. 14 is a perspective view showing the rack gear assembly according to the embodiment of the present disclosure is installed in the refrigerator, the view being taken at a lower portion thereof.

As shown in FIGS. 13 and 14, two rack gear assemblies 600 may be respectively provided on opposite sides of the lower surface of the storage bin 220 constituting the drawer 200. As the rack gear assemblies 600 have respectively rack gears 611 and 621 on lower surfaces thereof, the rack gear assemblies 600 may engage with the pinions 410 that are exposed to the inside of the lower storage chamber 3.

The rack gears 611 and 621 (of the rack gear assembly 600) may extend from a front side of the lower surface of the storage bin 220 to a rear side thereof. Thus, the drawer 200 provided with the rack gear assemblies 600 may move forward and rearward from the lower storage chamber 3 while being moved forward and rearward by rotation movement of the pinions 410.

The pinions 410 and the rack gear assemblies 600 may be respectively made in pairs of at least three pinions and at least three rack gear assemblies.

As an automatic pushing-out distance of the storage bin 220 is increased, usability of the drawer 200 may improve.

That is, as a storage space in the storage bin 220 is maximally moved in the opposite direction from the lower storage chamber 3, the drawer 200 may be provided such that it is easy to store the container 240 in the storage bin 220, or to store items and food in the storage space.

The container 240 may be automatically raised by the raising/lowering module 300 when the drawer 200 is opened. Thus, the storage bin 220 may be maximally separated from the lower storage chamber 3.

The two pinions 410 may be positioned on a portion of the front side of the lower storage chamber 3, and lengths of the rack gears 611 and 621 may be maximally long.

As the two pinions 410 are positioned close to a portion of the front side of the lower storage chamber 3 and the rack gears 611 and 621 have the long lengths, the pushing-out distance of the storage bin 220 may be increased.

However, a front to rear length of the lower surface of the storage bin 220 may be formed shorter than an open upper surface of the storage bin 220. In view of that, the rack gears 611 and 621 may have limited lengths.

Accordingly, the rack gear assemblies 600 may be configured to extend in lengths thereof, thereby increasing the pushing-out distance of the storage bin 220.

That is, even when the front to rear length of the storage bin 220 is short, the lengths of the rack gear assemblies 600 extend, thereby allowing the storage bin 220 to be pushed further out.

Each of the rack gear assemblies 600 may include a first rack member 610 and a second rack member 620, and a confining module 670 that are pushed out while being moved forward in order, as shown in FIGS. 15 to 23.

The rack gear assembly 600 may be described in detail by each part as follows.

The first rack member 610 may perform forward and rearward movement of the storage bin 220 by rotation of the pinion 410, and the first rack member 610 may have a rack gear 611.

The first rack member 610 may be provided such that an upper surface thereof is fixed to the lower surface of the storage bin 220 while being in close contact thereto (referring to FIG. 14). A plurality of coupling holes 612 may be provided on the first rack member 610, and the first rack member 610 may be attached to the storage bin 220 by screwing through the coupling holes 612.

Figure 15:
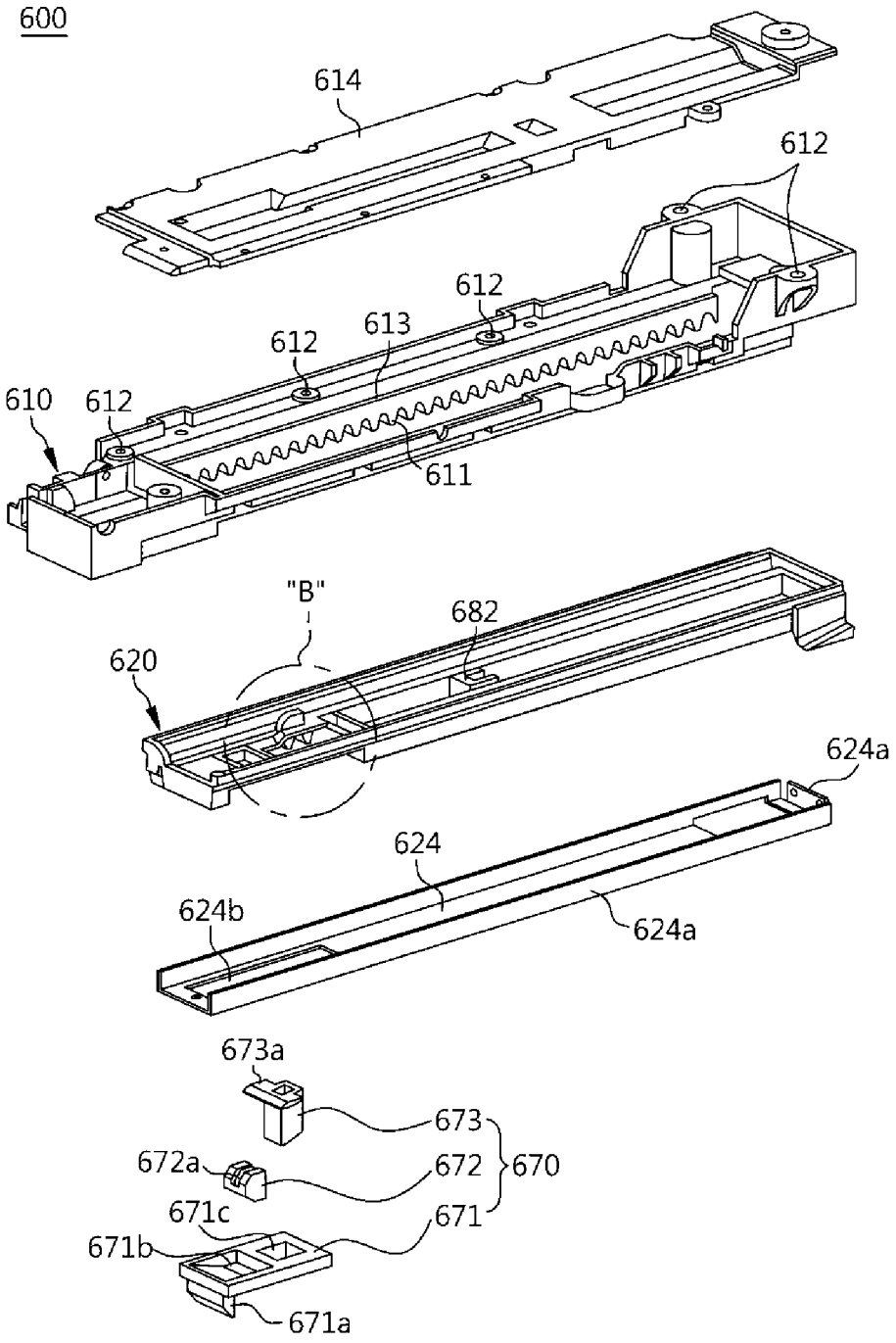
FIG. 15 is an exploded-perspective view showing each of the rack gear assemblies according to the embodiment of the present disclosure, the view being taken at an upper side of the rack gear assembly.
Figure 16:
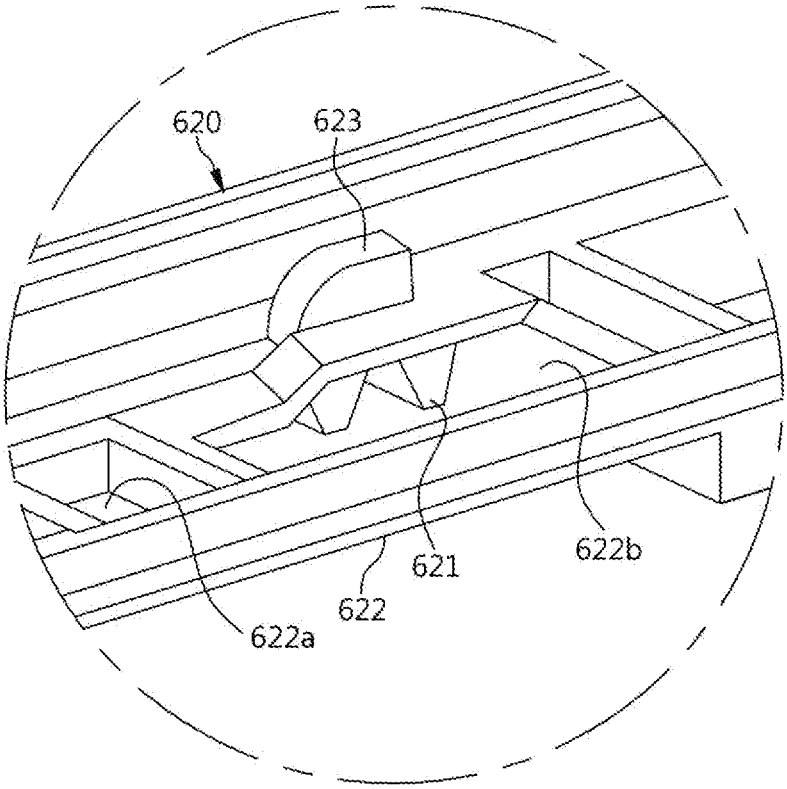
FIG. 16 is an enlarged view of "B" part in FIG. 15.
Figure 17:
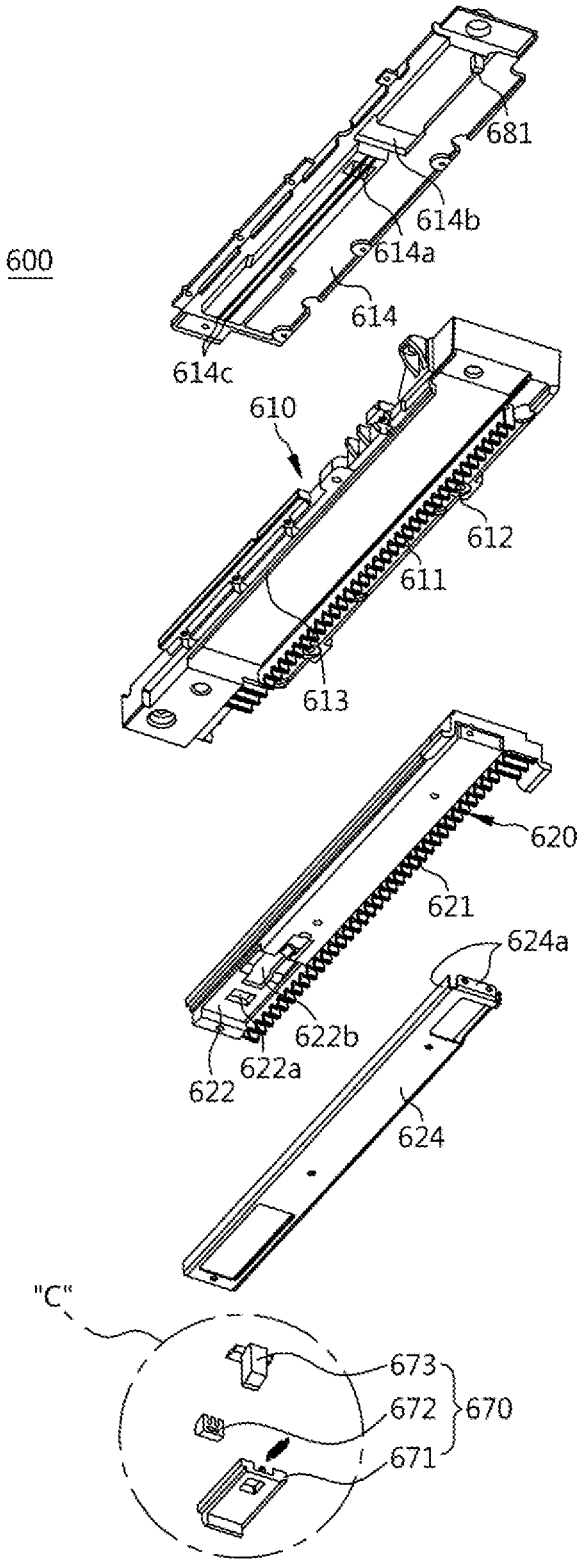
FIG. 17 is an exploded-perspective view showing the rack gear assembly according to the embodiment of the present disclosure, the view being taken at the lower side thereof.
Figure 18:
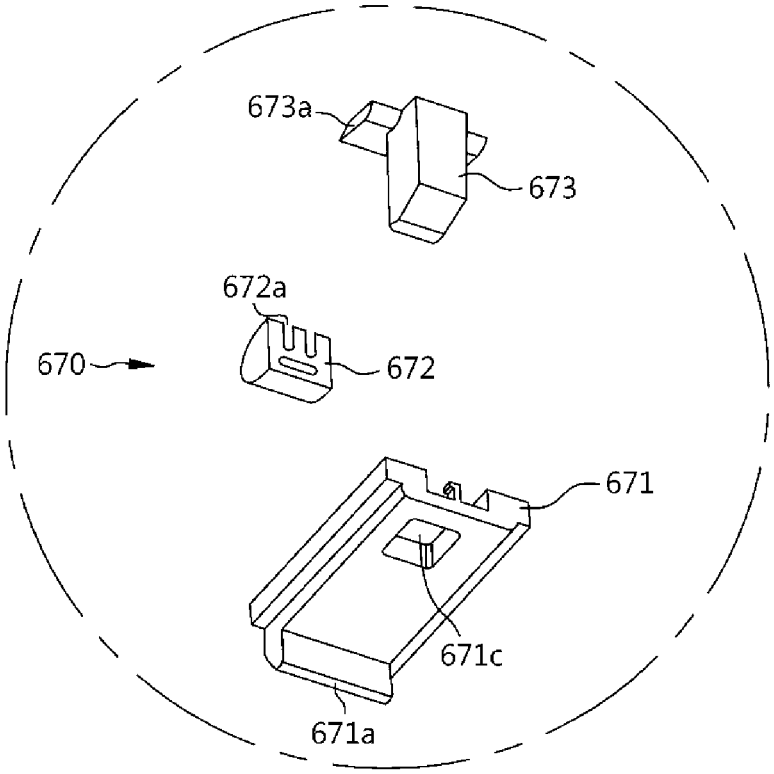
FIG. 18 is an enlarged view of "C" part in FIG. 17, the view showing a confining module of the refrigerator according to the embodiment of the present disclosure.
Figure 19:
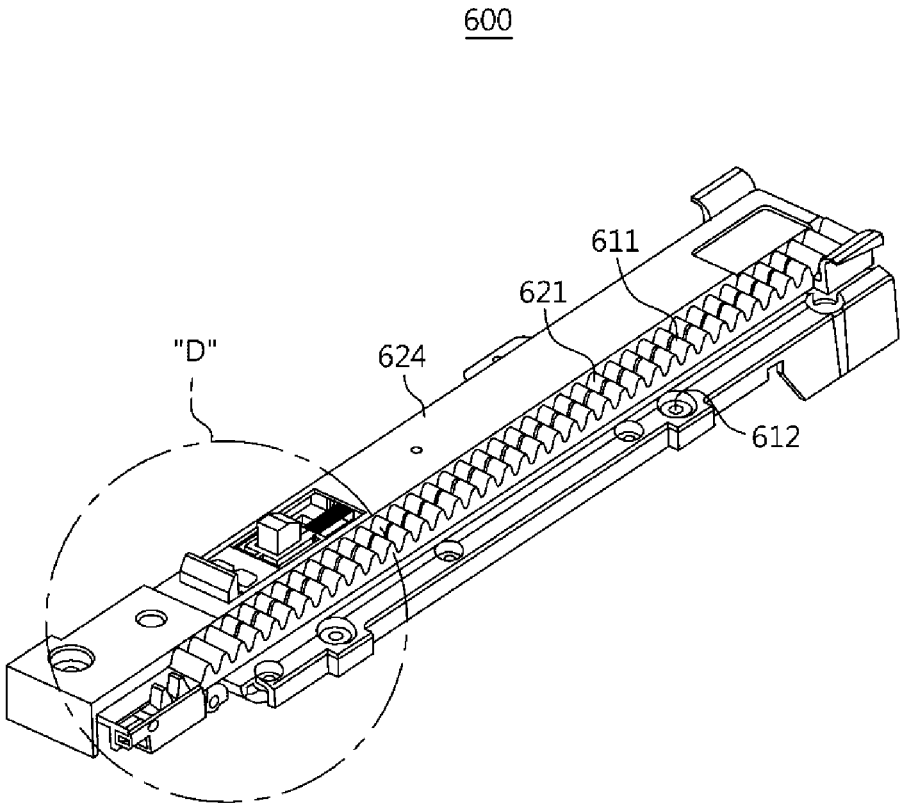
FIG. 19 is a perspective view showing the rack gear assembly of the refrigerator according to the embodiment of the present disclosure, the rack gear assembly being overturned for showing a lower surface structure thereof.
Figure 20:
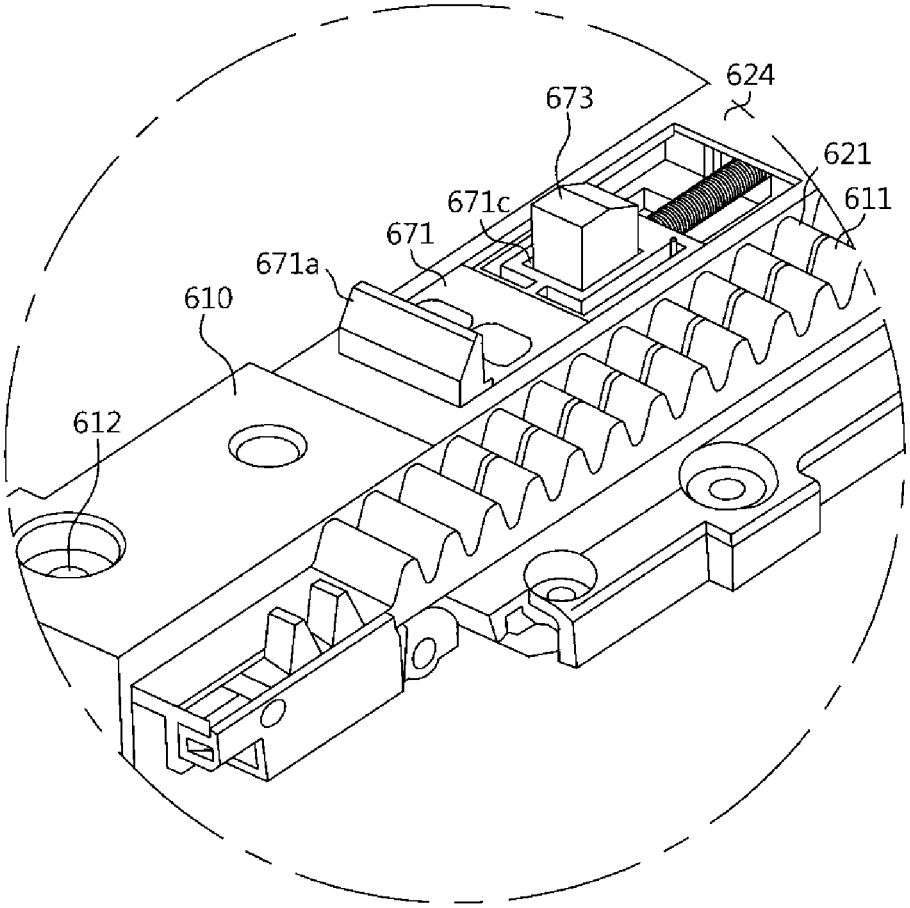
FIG. 20 is an enlarged view of "D" part in FIG. 19.
Figure 21:
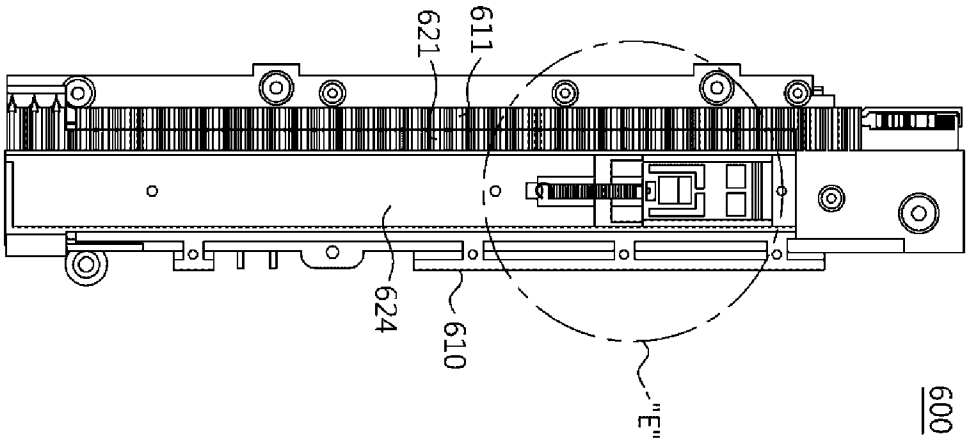
FIG. 21 is a bottom view showing the lower surface structure of the rack gear assembly of the refrigerator according to the embodiment of the present disclosure.
Figure 22:
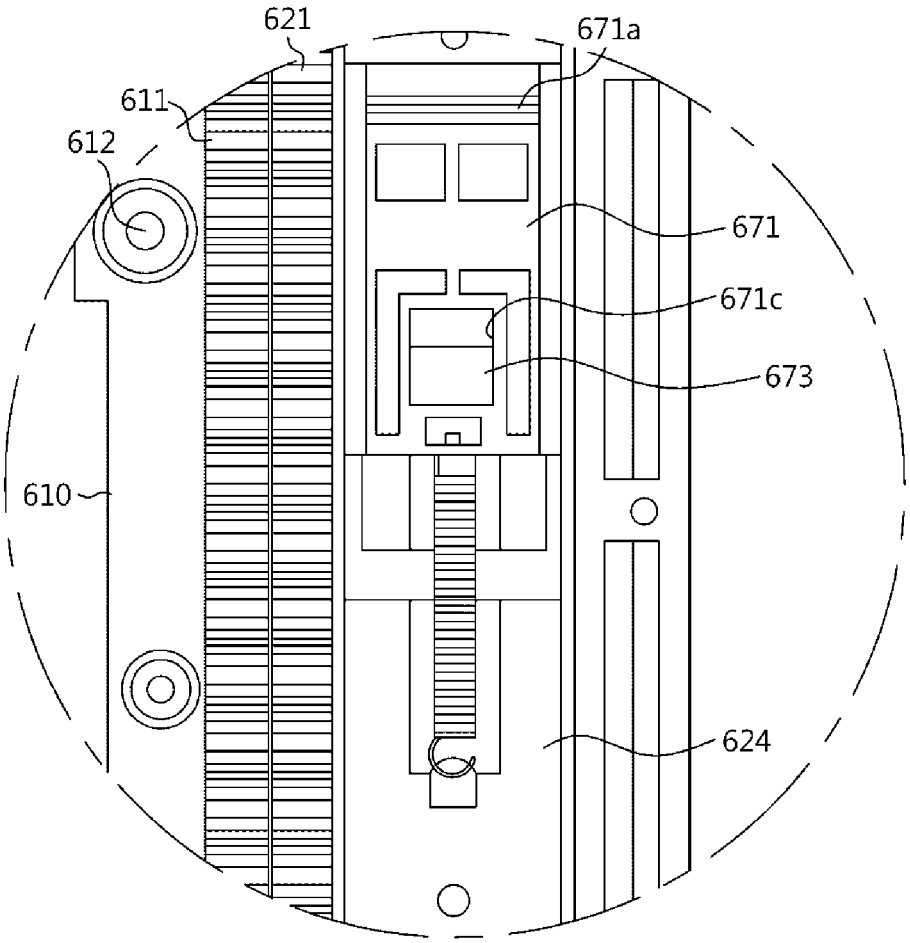
FIG. 22 is an enlarged view of "E" part in FIG. 21.

The second rack member 620 may be at a lower surface of the first rack member 610, and thus the first rack member 610 may have a movement guiding groove 613 that is formed in the depressed manner and supports sliding movement of the second rack member 620 (referring to FIGS. 15 and 17).

The movement guiding groove 613 may be provided in the depressed manner from a front end portion of the first rack member 610 and formed by penetrating through a rear surface of the first rack member 610. That is, the second rack member 620 received at the movement guiding groove 613 may be exposed to the rear of the movement guiding groove 613.

The rack gear 611 of the first rack member 610 may be provided on any one side (one side in the opposite direction between two rack gear assemblies) of the movement guiding groove 613 along a longitudinal direction of the first rack member 610 in which the rack gear 611 is included.

The rack gear 611 may be further forward than the movement guiding groove 613.

The first rack member 610 may include a first rack cover 614.

The movement guiding groove 613 provided in the first rack member 610 has an inside portion that is open vertically so that a holder 672 and a locking member 673, which are included in the confining module 670, may pass through the movement guiding groove 613. The first rack cover 614 covers the upper surface of the first rack member 610 by being coupled thereto, so that a lower surface of the first rack cover 614 covers an open portion of the movement guiding groove 613 provided on the first rack member 610 and is provided as an upper surface in the movement guiding groove 613.

The first rack cover 614 may be formed of a metal plate to reinforce insufficient strength of the first rack member 610.

The lower surface (upper surface in the movement guiding groove) of the first rack cover 614 may include receiving grooves 614*a* and 614*b* in which the holder 672 and the locking member 673 of the confining module 670 are respectively received.

The receiving grooves 614*a* and 614*b* include a first receiving groove 614*a* for receiving the holder 672 and a second receiving groove 614*b* for receiving the locking member 673. The two receiving grooves 614*a* and 614*b* are spaced apart from each other in a moving direction of the first rack member 610. A spaced distance between a rear surface of the first receiving groove 614*a* and a rear surface of the second receiving groove 614*b* is longer than a spaced distance between a rear surface of the holder 672 and a rear surface of the locking member 673.

The receiving grooves 614*a* and 614*b* are configured such that the holder 672 is firstly received into the first receiving groove 614*a* and then the locking member 673 is received into the second receiving groove 614*b*.

Unlike the above-described embodiment, the first rack cover 614 and the first rack member 610 may be provided as a single body through an injection molding manner.

However, when the first rack member 610 and the first rack cover 614 are configured as the single body, it is difficult for the injection molding thereof. That is, the first rack member 610 and the first rack cover 614 are different in shapes and directions at uneven portions thereof, so that the injection molding thereof is difficult.

Accordingly, as shown in the embodiment, the first rack member 610 and the first rack cover 614 may be separately manufactured and then coupled to each other.

The second rack member 620 may perform the forward and rearward movement of the storage bin 220 together with the first rack member 610.

The second rack member 620 is inserted in the movement guiding groove 613 of the first rack member 610. When the first rack member 610 is moved by a preset distance, the second rack member 620 is moved forward by leading of the first rack member 610 and receives the rotational force of the pinion 410. As the second rack member 620 is continuously moved forward by rotational force of the pinion 410, the first rack member 610 is further pushed out even when the rack gear 611 of the first rack member 610 is separated from the pinion 410.

The first rack member 610 may lead the second rack member 620 through a linkage part 680 so that the second rack member 620 is moved.

The linkage part 680 may include a linkage protrusion 681 (referring to FIG. 17) and a linkage step 682 (referring to FIG. 15), where the linkage protrusion 681 is provided on the lower surface (lower surface in the movement guiding groove) of the first rack cover 614 and the linkage step 682 is provided on an upper surface of the second rack member 620. When the first rack member 610 is moved forward by the preset distance, the linkage protrusion 681 and the linkage step 682 are in contact with each other to perform forward movement of the second rack member 620.

Although not shown, the linkage protrusion 681 may be provided on the first rack member 610. Although not shown, the linkage protrusion 681 may be provided on the upper surface of the second rack member 620 and the linkage step 682 may be provided on a lower surface of the first rack member 610.

When the second rack member 620 is fully inserted into the movement guiding groove 613 of the first rack member 610, a spaced distance between the linkage protrusion 681 and the linkage step 682 is configured as a distance that is set such that the first rack member 610 is moved forward without affecting the second rack member 620. The preset distance may be determined based on a size or a total pushing-out distance of the storage bin 220.

The second rack member 620 may be provided with a rack gear 621. The rack gear 621 is formed alongside a side portion of the rack gear 611 of the first rack member 610. A front end of the rack gear 621 is provided to be further rearward than a front end of the rack gear 611 of the first rack member 610, and a rear side end thereof is provided to extend to the further rear side than a rear side end of the rack gear 611 of the first rack member 610.

The rack gears 611 and 621 of the first rack member 610 and the second rack member 620 may easily receive the driving force of the pinions 410, respectively. That is, since the pinions 410 are formed to have the width that is a size of adding a width of the rack gear 611 of the first rack member 610 and the rack gear 621 of the second rack member 620, each of the rack gears 611 and 621 can efficiently receive the driving force of the pinions 410.

A motion groove 622 may be provided on a front lower surface of the second rack member 620 in a depressed manner. The motion groove 622 may provide a motion space in which a stopper member 671 of the confining module 670 is moved forward and rearward in a mounted state.

The motion groove 622 may be provided with a plurality of through holes 622*a* and 622*b* in an upward penetrating manner. The through holes 622*a* and 622*b* may include a first through hole 622*a* through which the holder 672 passes and a second through hole 622*b* through which the locking member 673 passes. The holder 672 and the locking member 673 are included in the confining module 670 and may be described below.

The second through hole 622*b* may be formed in a horizontally long hole so that forward and rearward movement of the locking member 673 may be performed.

A second rack cover 624 may be provided at a lower surface of the second rack member 620. The second rack cover 624 may cover the lower surface of the second rack member 620.

The second rack cover 624 may prevent the stopper member 671, mounted to the motion groove 622 of the second rack member 620, from being separated to the outside.

The second rack cover 624 may be formed of a metal plate and may cover the lower surface of the second rack member 620. Thus, deformation such as torsion or bending of the second rack member 620 may be prevented. The second rack cover 624 may be provided with a partially open portion for reducing the weight thereof.

The second rack cover 624 may be provided with folded ends 624*a* in a folded manner on opposite side surfaces and a rear surface thereof. The folded ends 624*a* cover parts of the opposite side surfaces and the rear surfaces of the second rack member 620 to prevent torsion of the second rack member 620.

The second rack cover 624 may include an exposure hole 624*b* on a front end portion thereof, and the stopper member 671 may be partially exposed through the exposure hole 624*b*.

The confining module 670 may confine the second rack member 620 until the first rack member 610 is fully pushed out.

The confining module 670 includes the confining protrusion part 650, the stopper member 671, the holder 672, and the locking member 673. Connection between the stopper member 671, the holder 672, and the locking member 673 may be shown in FIGS. 15, 17, and 18.

The confining protrusion part 650 may be a single body in which an upper surface is close and a lower surface is open, and the confining protrusion part 650 is provided on a front upper surface of the bottom 120 constituting the cabinet 100.

Figure 23:
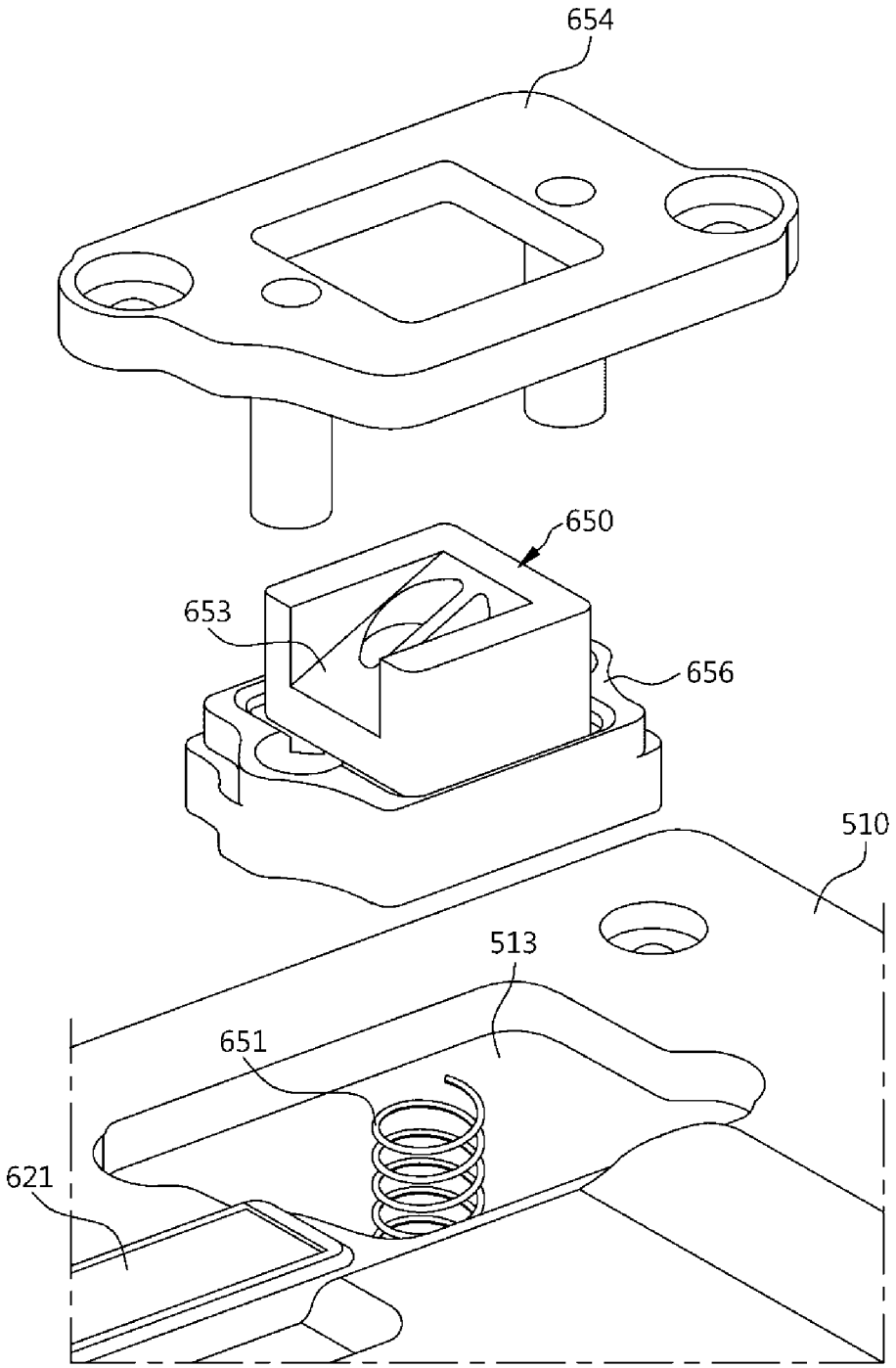
FIG. 23 is an exploded-perspective view showing a confining protrusion part of the refrigerator according to the embodiment of the present disclosure.
Figure 24:
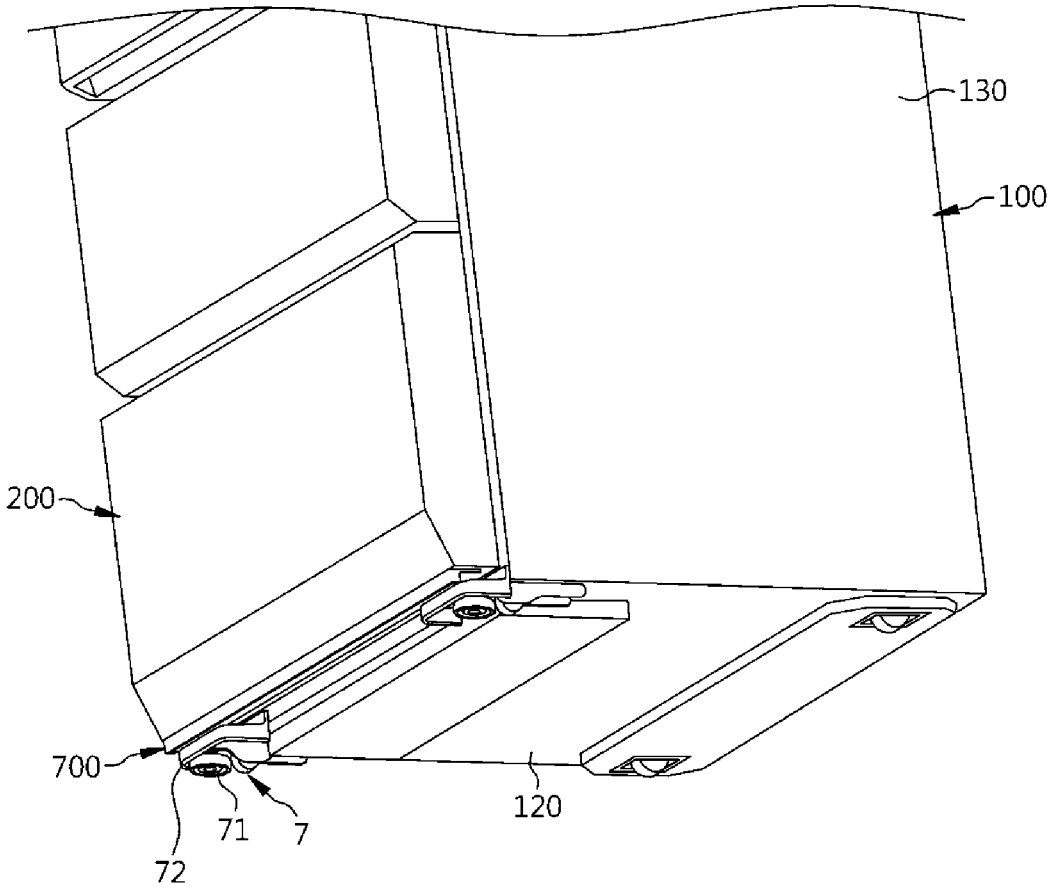
FIG. 24 is a main part perspective view showing the refrigerator, the main part being taken at a front side of a lower portion of the refrigerator, wherein a shock absorption module according to an example embodiment of the present disclosure is installed in the refrigerator.
Figure 25:
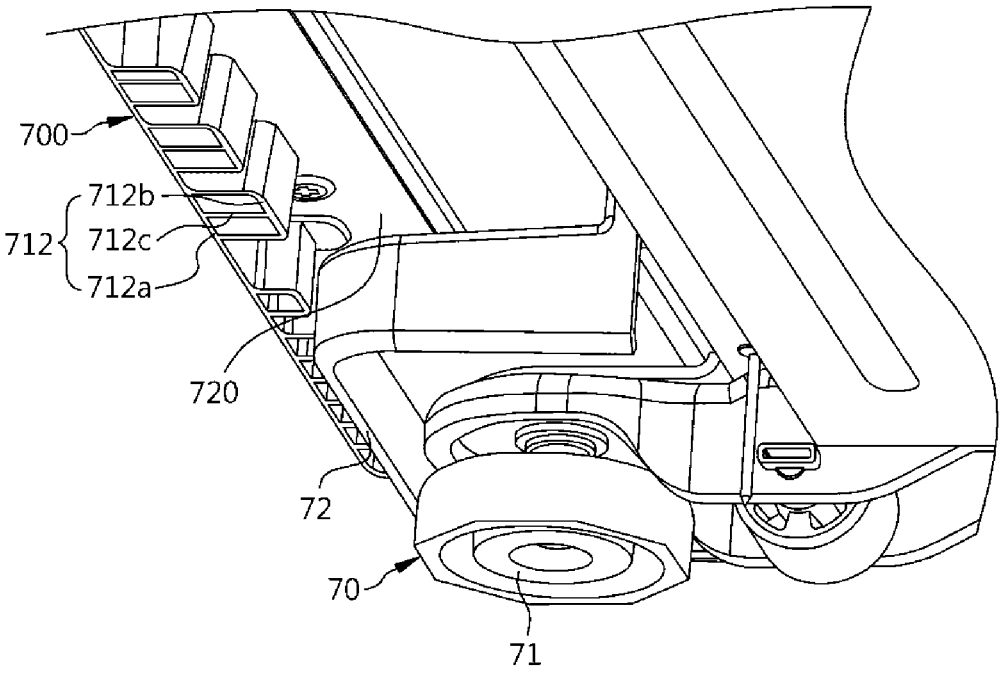
FIG. 25 is a main part perspective view showing the refrigerator, the main part being taken at a rear side of the lower portion of the refrigerator, wherein the shock absorption module according to an example embodiment of the present disclosure is installed in the refrigerator.
Figure 26:
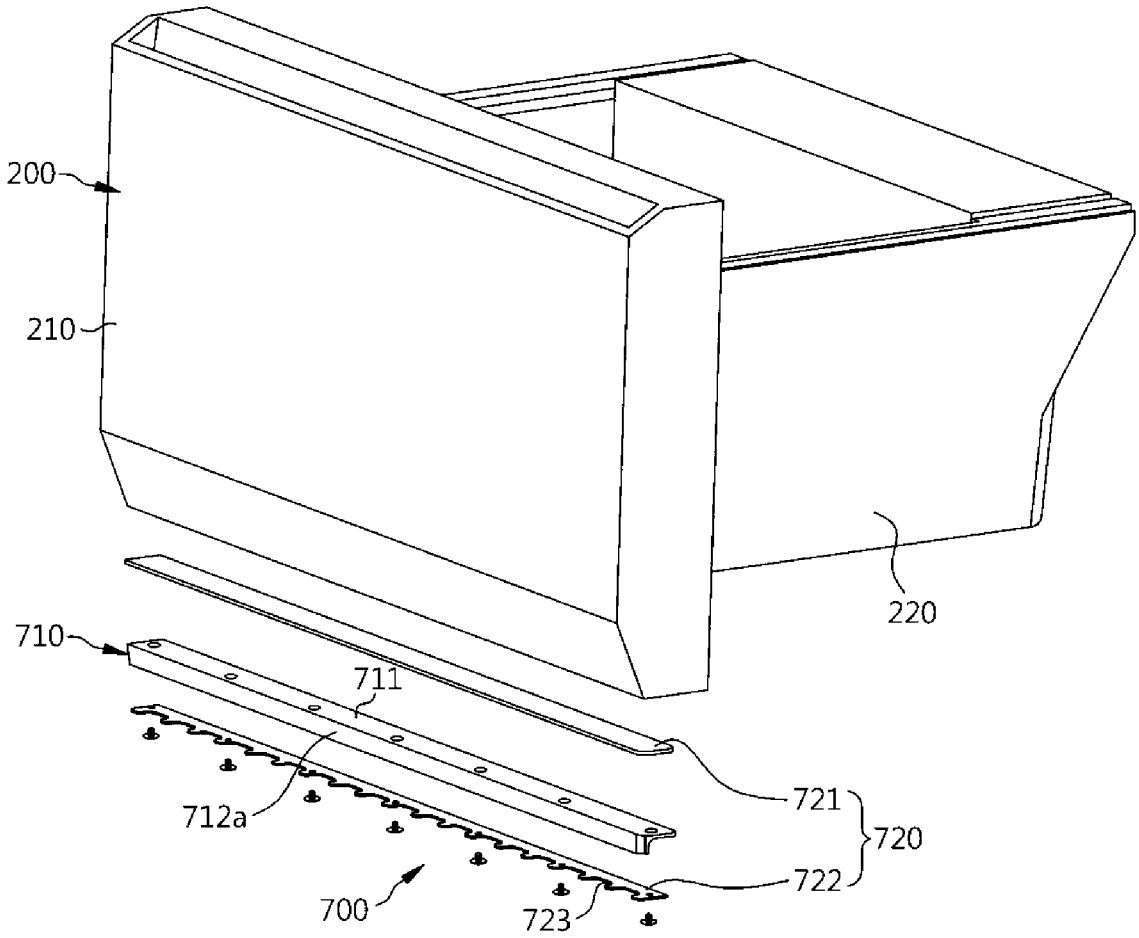
FIG. 26 is an exploded-perspective view showing the shock absorption module according to an example embodiment of the present disclosure, the view being taken at an upper side of the shock absorption module.
Figure 27:
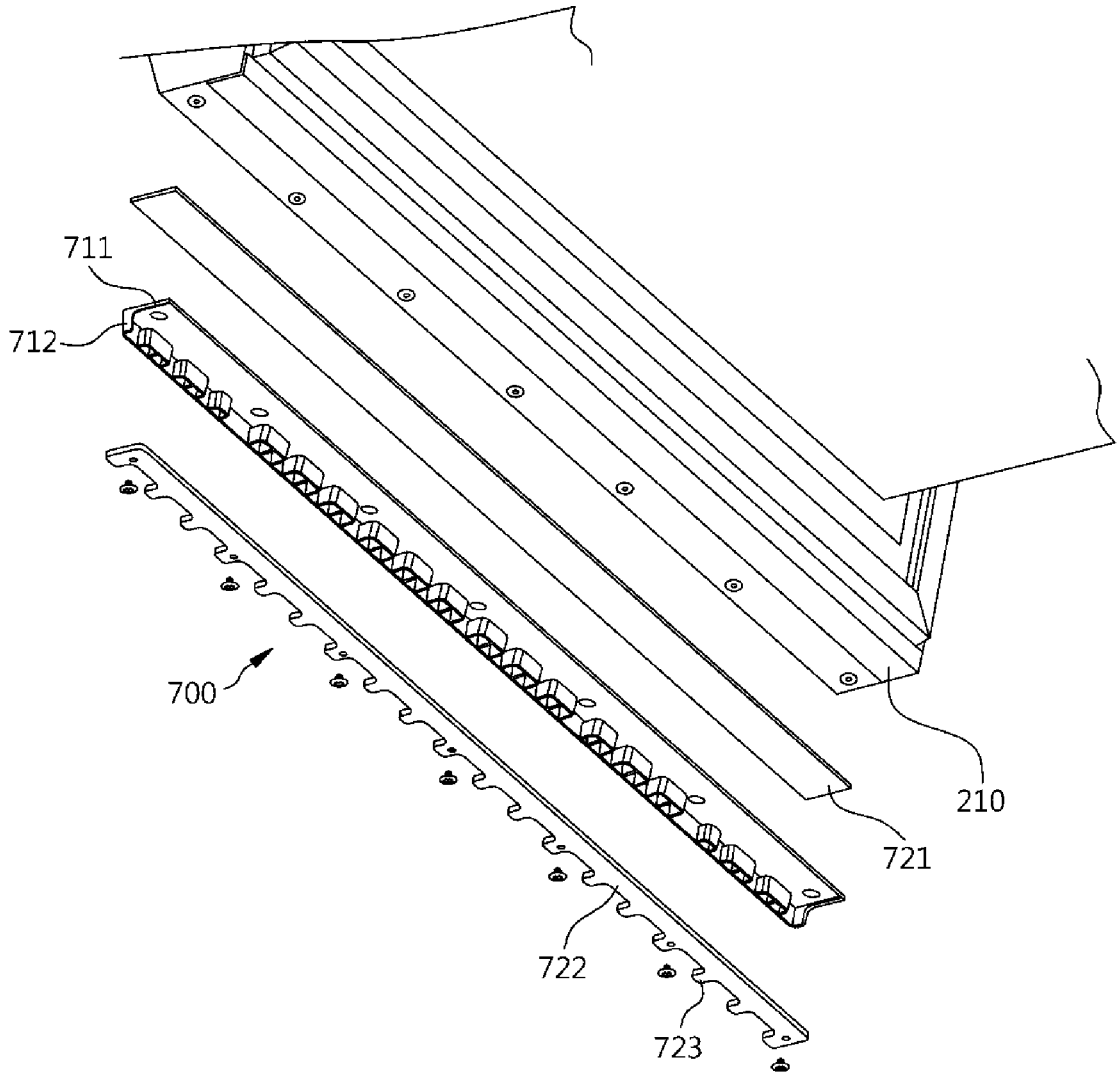
FIG. 27 is an exploded-perspective view showing the shock absorption module of the refrigerator according to an example embodiment of the present disclosure, the view being taken at a lower portion thereof.
Figure 28:
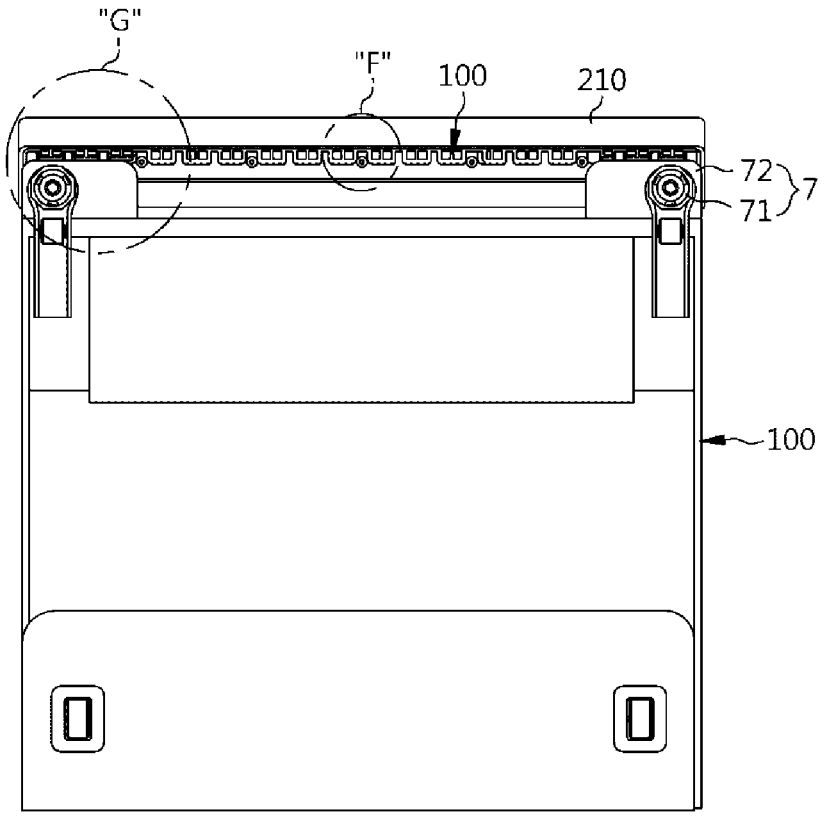
FIG. 28 is a bottom view of the refrigerator, the view showing the shock absorption module of the refrigerator according to an example embodiment of the present disclosure.
Figure 29:
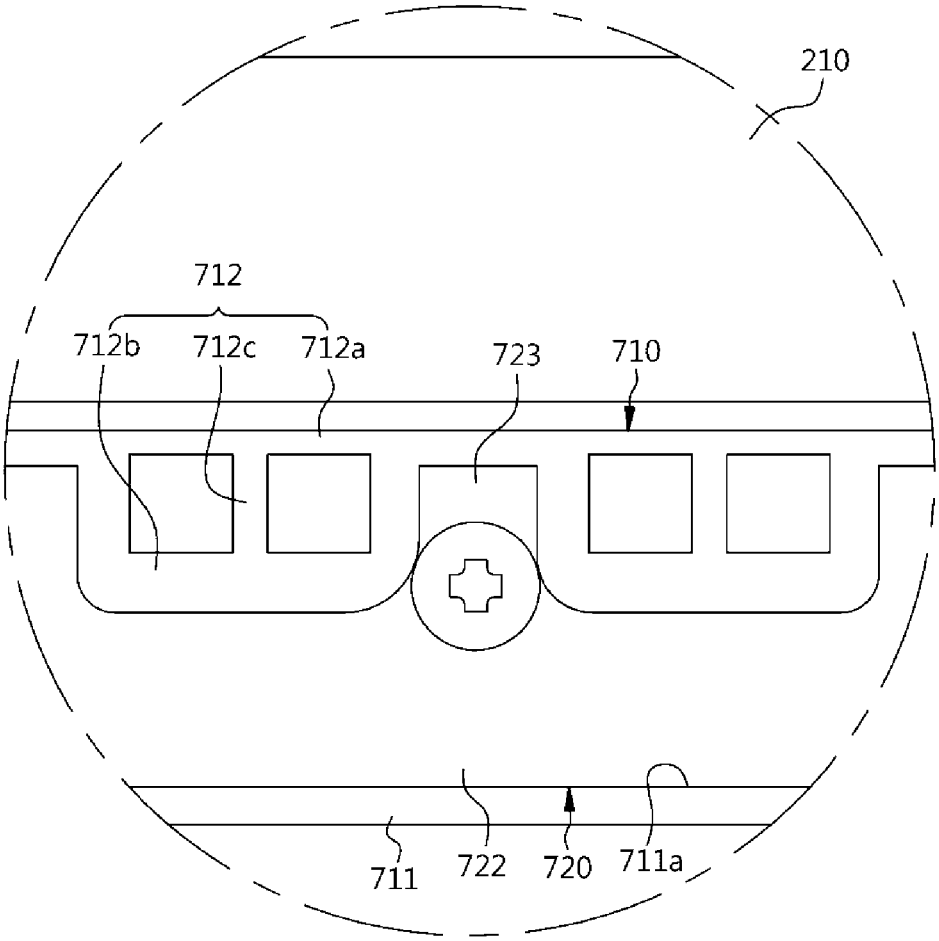
FIG. 29 is an enlarged view of "F" part in FIG. 28.
Figure 30:
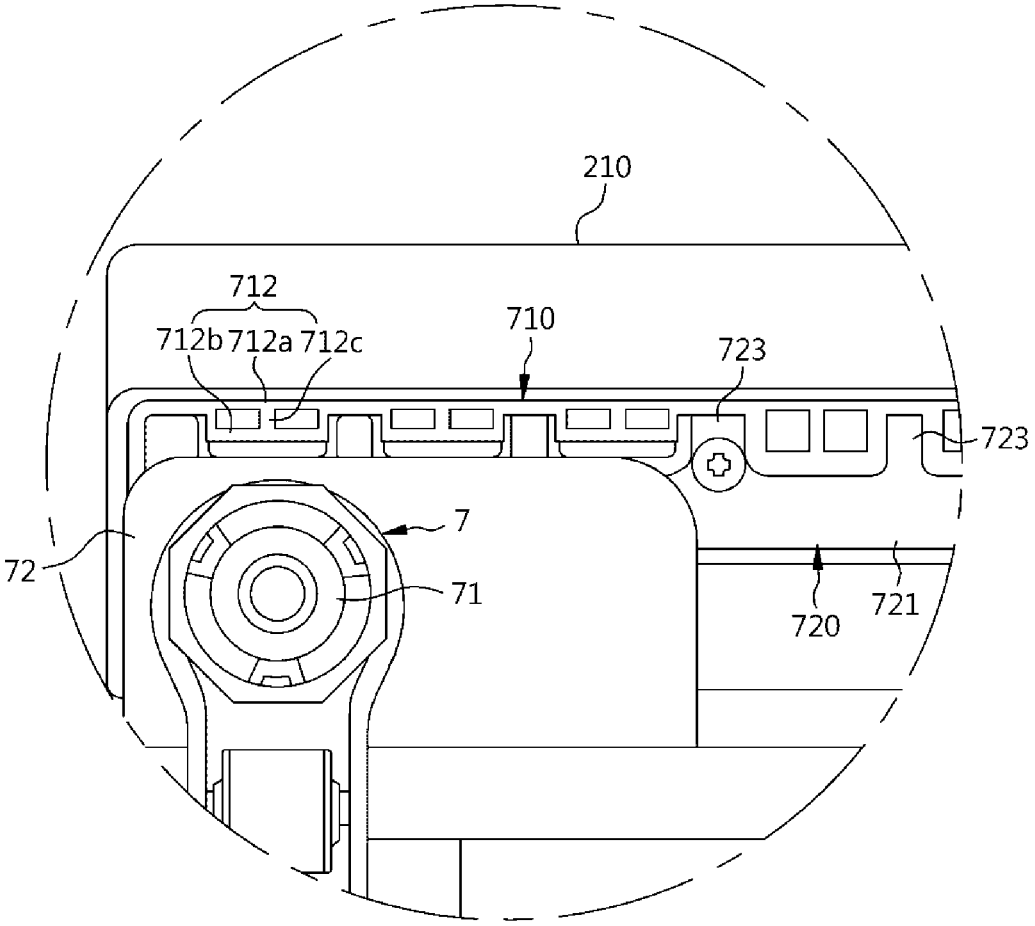
FIG. 30 is an enlarged view of "G" part in FIG. 28.
Figure 31:
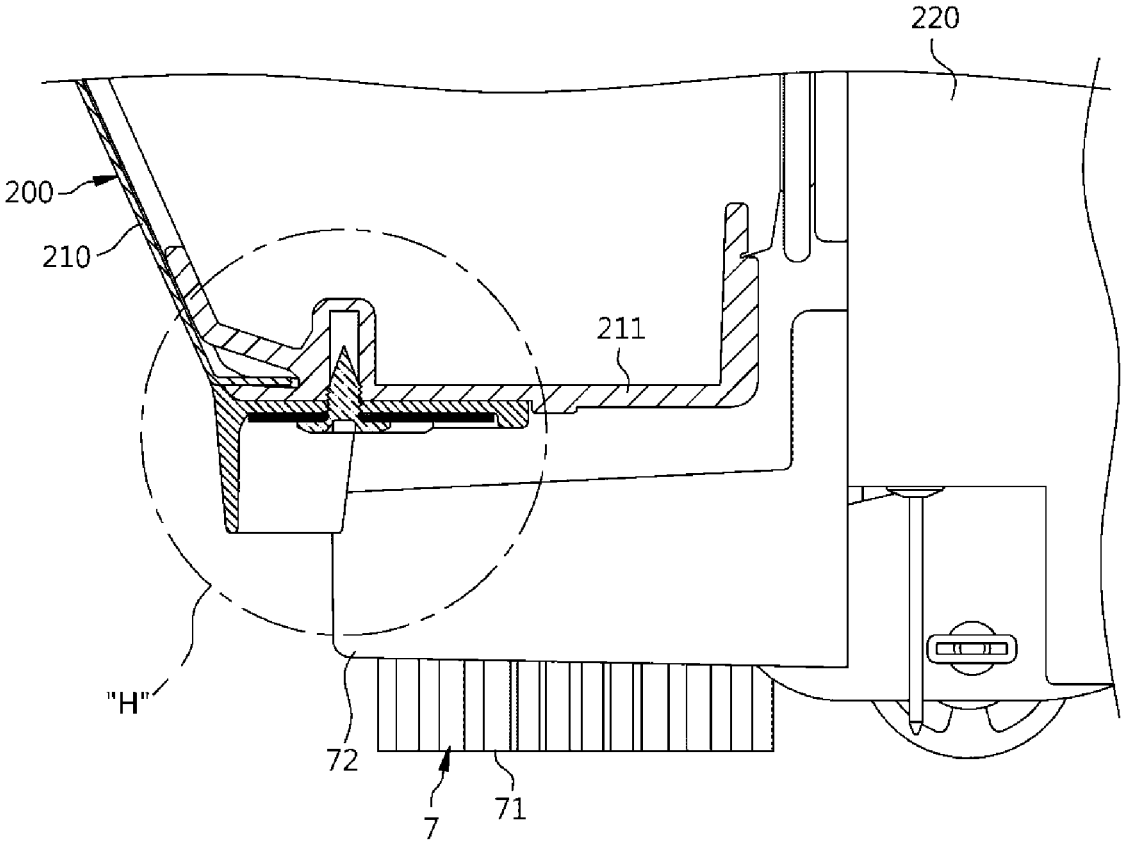
FIG. 31 is a sectional view, in which a part of the shock absorption module is cut, for showing the shock absorption module of the refrigerator according to an example embodiment of the present disclosure.

The confining protrusion part 650 may be inserted in the protrusion passing hole 513 formed through the cover plate 510 as shown in FIG. 23. When the cover plate 510 is not provided, the confining protrusion part 650 is installed in the upper surface of the bottom 120 of the cabinet 100.

The confining protrusion part 650 may be elastically raised in the protrusion passing hole 513 by an elastic member 651, and may extrude to the inside of the lower storage chamber 3 from the protrusion passing hole 513 when pressure is not applied. The elastic member 651 may include a coil spring and an upper end thereof passes through the lower surface of the confining protrusion part 650 to be engaged with a spring engagement protrusion 652 (referring to FIG. 38) in the confining protrusion part 650.

At a center portion of an upper surface of the confining protrusion part 650, a slope 653 may be inclined upward such that the front is low and the rear is high. As the locking member 673 of the confining module 670 is moved backward along the slope 653, the confining protrusion part 650 may move backward.

The confining protrusion part 650 may have an extended lower end compared to other parts. At an upper circumference of the confining protrusion part 650, a confining holder 654 may block the extended portion 656 of the confining protrusion part 650, and the confining holder 654 may be attached to the cover plate 510 and prevent separation of the confining protrusion part 650.

The confining protrusion part 650 may be positioned in a rear of the pinion 410, and may be closest to the pinion 410.

The stopper member 671 may be installed in the motion groove 622 of the second rack member 620, and may function to restrict the rearward movement of the second rack member 620. A length (from the front to the rear) of the stopper member 671 may be shorter than a length (from the front to the rear) of the motion groove 622, so that the stopper member 671 is installed to be moveable in forward and rearward directions within the motion groove 622.

The stopper member 671 may include a confining hook 671*a* at a lower surface of a front end thereof, and such that the confining hook 671*a* protrudes downward. When the drawer 200 is closed to enter the preset distance, the confining hook 671*a* is hit at a front surface of the confining protrusion part 650 to prevent the stopper member 671 and the first rack member 610 from being moved backward.

A holder groove 671*b* is provided on a front upper surface of the stopper member 671, and a locking member through hole 671*c* is provided on a rear side portion of the stopper member 671.

The holder groove 671*b* may be gradually inclined downward such that the front is high and the rear is low. Therefore, when the holder 672 received inside the holder groove 671*b* is moved forward, the holder 672 may be easily separated from the holder groove 671*b*.

The holder 672 may restrict the forward and rearward movement of the stopper member 671.

A lower end of the holder 672 is received in the holder groove 671*b* of the stopper member 671, and an upper end of the holder 672 is installed to pass through a first through hole 622*a* of the second rack member. Thus, the first rack member 610 may be pushed out by the preset distance to lead the second rack member 620, the holder 672 moved forward with the second rack member 620 is separated from the holder groove 671*b* and is received in the first receiving groove 614*a* of the first rack cover 614.

The holder 672 has inclined front upper and lower edges, and a front lower edge of the holder 672 is inclined at the same slope as the holder groove 671*b*. Thus, the holder 672 may easily separate from the holder groove 671*b*.

The holder 672 has a cut groove 672*a* that is cut in forward and rearward direction on an upper surface of the holder 672, and an insert protrusion 614*c* received in the cut groove 672*a* is provided on a lower surface of the first rack cover 614, the lower surface thereof facing the upper surface of the holder 672, the insert protrusion 614*c* is formed from a front end of the first rack cover 614 to the first receiving groove 614*a*. That is, due to a structure between the cut groove 672*a* and the insert protrusion 614*c*, during movement of the first rack member 610, the holder 672 is prevented from moving laterally so as to be precisely received in the first receiving groove 614*a*. The cut groove 672*a* and the insert protrusion 614*c* may be provided in plural.

The locking member 673 may prevent the forward movement of the second rack member 620 by being locked in a position of the rear of the confining protrusion part 650 until the first rack member 610 is pushed out by the preset distance.

The locking member 673 is moved upward when the first rack member 610 and the first rack cover 614 are pushed out by the preset distance and moved with the second rack member 620 and the second rack cover 624. Then, the locking member 673 is inserted in the second receiving groove 614*b* of the first rack cover 614 positioned above the locking member to be operated for releasing the engagement with the confining protrusion part 650.

An extending step 673*a* may be provided at an upper end of the locking member 673 in a shape of extending laterally, and a raising guide step 623 may be provided on opposite side portions of the second through hole 622*b* at a front upper surface of the second rack member 620. The raising guide step 623 may be formed in a rounded shape (or inclined shape) so as to raise the extended step 673*a* when the first rack member 610 and the first rack cover 614 are pushed out by the preset distance and moved with the second rack member 620 and the second rack cover 624 (referring to FIG. 16).

That is, when the first rack member 610 and the first rack cover 614 are pushed out by the preset distance and moved with the second rack member 620 and the second rack cover 624, the raising guide step 623 provided on the second rack member 62 raises the extended step 673*a* of the locking member 673, thus the locking member 673 rises up to a height where the locking member 673 is not hit from the confining protrusion part 650.

The raising guide step 623 may be rounded or inclined upward such that the front is low and the rear is high. The raising guide step 623 may be gradually inclined upward such that the front (at the center of the opposite side portions of second through hole 622*b*) is low and the rear is high. That is, the raising guide step 623 is provided so that the locking member 673 is not affected by the raising guide step 623 when it is positioned in the front of second through hole 622*b*, and is gradually moved upward by affecting by the raising guide step 623 when the locking member 673 is moved to the rear of the second through hole 622*b* by the forward movement of the second rack member 620.

The extended step 673*a* (of the locking member 673) may be preferably rounded or inclined like the raising guide step 623.

A lower surface of the locking member 673 may be inclined upward such that the front is low and the rear is high. A slope of the lower surface of the locking member 673 is the same as the slope 653 formed at the center of the upper surface of the confining protrusion part 650.

The shock absorption module 700 of the refrigerator according to an embodiment of the present disclosure may be described with reference to FIGS. 24 to 36. Other embodiments and configurations may also be provided. The shock absorption module may also be called a shock absorber.

The shock absorption module 700 (or shock absorption device) is a part for absorbing a shock applied to the drawer 200. The shock may be generated when the drawer 200 is opened and hits the floor.

The drawer 200 may open while being automatically moved forward, by the drawer 200 being operated regardless of a user's intension.

For example, the drawer 200 may open by malfunction of a proximity sensor, and/or the drawer 200 may open when the user mal-operates the button 6.

When the user is aware of opening of the drawer 200, there may be no risk of a safety accident since the user is not in an opened area of the drawer 200. However, when the user is in front of the drawer 200 and the pushing out of the drawer 200 is automatically performed by the malfunction or false manipulation, or when the user is in the opened area of the drawer 200 inadvertently, a safety accident may occur as an edge at the front lower surface of the front panel 210 of the drawer 200 hits a user's instep and the edge thereof gradually climbs on the instep.

Even when the drawer 200 does not hit the user's instep, a shock may occur by the front panel 210 (of the drawer 200) falling down and hitting the floor when weight of stored objects in the storage bin 220 are excessively heavy while the drawer 200 is fully opened.

The shock absorption module 700 is provided in an embodiment so that the shock absorption module 700 maximally absorbs shock to prevent or minimize the risk of the safety accident even when the user suffers injury on the user's instep since the user is in the opened area of the drawer 200 or the drawer 200 is mal-operated, and/or the drawer 200 hits the floor.

The shock absorption module 700 may be provided on the lower surface of the front panel 210 (constituting the drawer 200), and may be provided along an edge of the front lower surface of the front panel 210. The position of the shock absorption module 700 may be shown in FIGS. 24 and 28. The position may also be shown in FIGS. 3 and 4.

The shock absorption module 700 may include a shock absorption part 710 (or shock absorption component).

The shock absorption part 710 may include an elastomer to absorb shock. In an embodiment, the shock absorption part 710 may be shown as being formed of thermo plastic elastomer (TPE). The shock absorption part 710 may be formed of EPDM rubber, EVA, PE, PU, and/or the like. That is, the shock absorption part 710 formed of the elastomer may prevent the safety accident when the drawer 200 stabs the user's instep or floor and may prevent brakeage of the floor and the front panel.

The shock absorption part 710 may include a close contact pad 711 (or contact pad) in close contact with the lower surface of the front panel 210, and a buffer end 712 that protrudes downward from a front lower surface of the close contact pad 711.

The close contact pad 711 may allow the shock absorption part 710 to be stably engaged with the front panel 210, and the buffer end 712 may improve an effect of reducing shock.

The buffer end 712 may include a front wall 712*a* forming a front surface, a rear wall 712*b* forming a rear surface, and a connection wall 712*c* connecting the front wall 712*a* and the rear wall 712*b* by crossing therebetween. That is, a plurality of rubber plates (front and rear walls 712*a* and 712*b*) may overlap in a movement direction of the drawer 200 so as to improve a buffering effect, and the connection wall 712*c* may prevent torsion of the rubber plates (front and rear walls 712*a* and 712*b*). The structure may be shown in FIGS. 25, 29, and 30.

Figure 32:
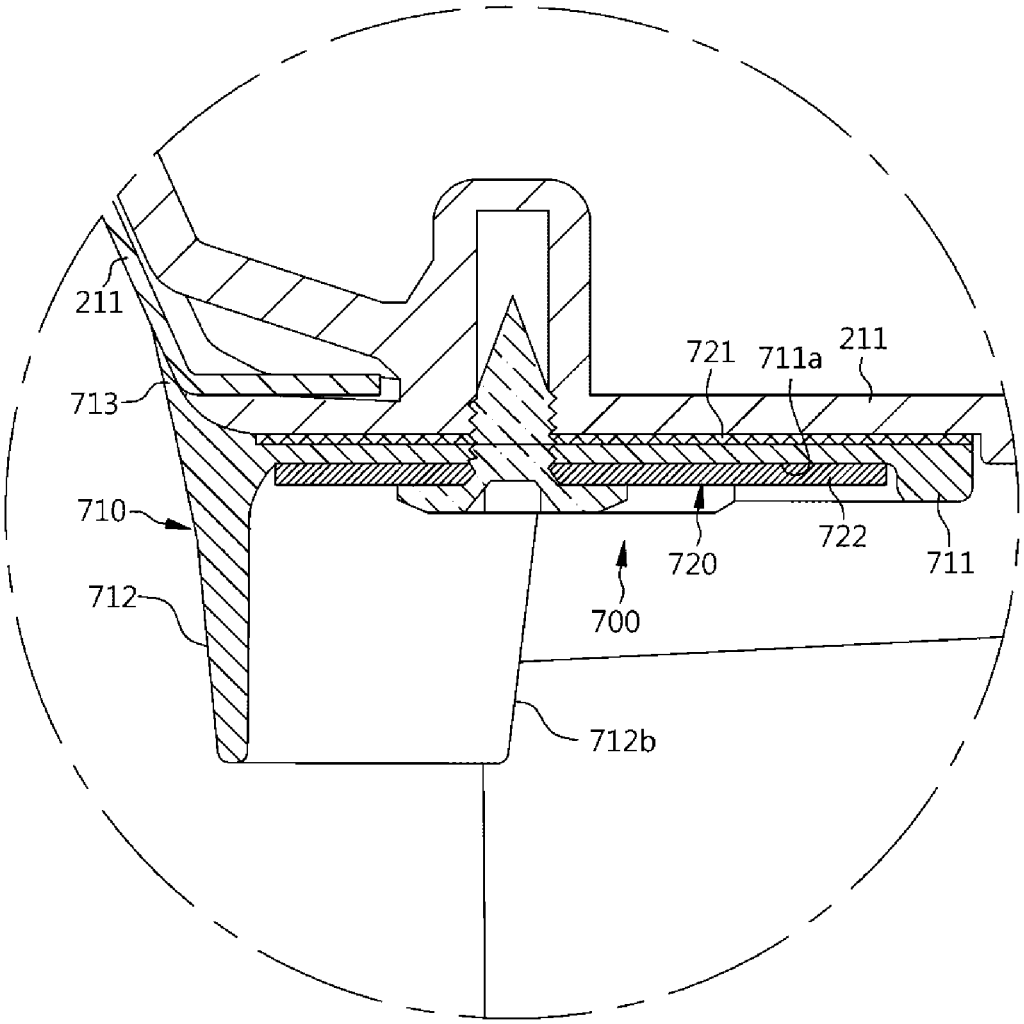
FIG. 32 is an enlarged view of "H" part in FIG. 31.

The rear wall 712*b* may be inclined forward such that the bottom of the rear wall is further forward than the top of the rear wall (referring to FIG. 32).

That is, when considering that the direction in which shock or pressure is applied to the shock absorption part 710 is equal to forward and rearward direction in which the drawer 200 is opened, the inclined structure of the rear wall 712*b* may be provided so that shock or pressure applied to the front wall 712*a* and the connection wall 712*c* in the forward and rearward direction may be reduced.

At least two buffer ends 712 may be laterally spaced apart from each other.

When the buffer end 712 is provided with a structure in which the front wall 712*a*, the rear wall 712*b*, and the connection wall 712*c* are formed over entire portion from one end of the front panel 210 to the other end of the front panel 210, when any one portion of the buffer end 712 is bent rearward by hitting the opposing object (for example, user's instep or the like), surrounding portions are all bent and thus a contact portion with the front panel 210 may be detached from the front panel 210.

Accordingly, through the structure (the plurality of buffer ends is provided and spaced apart from each other), the buffer end 712 is configured such that only the buffer end 712 where shock is applied causes local bending deformation, thereby minimizing detaching of the contact portion with the front panel 210.

Figure 33:
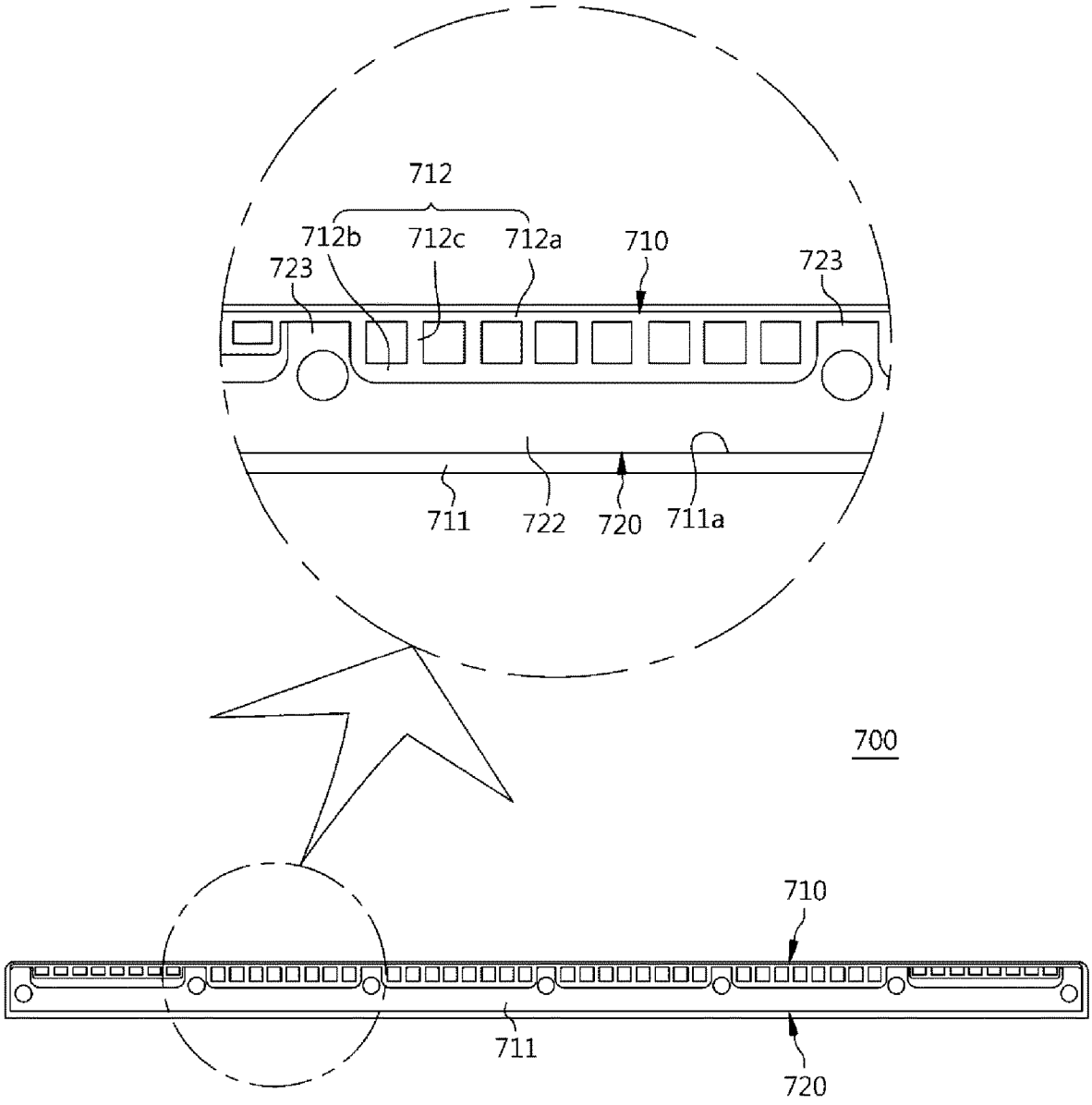
FIGS. 33 to 35 are bottom view showing various examples of the shock absorption module of the refrigerator according to an example embodiment of the present disclosure.

A spaced distance between the buffer ends 712 is preferably configured such that two or three connection walls 712*c*, one front wall 712*a*, and one rear wall 712*b* may constitute one buffer end 712. As shown in FIG. 33, at least four connection walls 712*c*, one front wall 712*a*, and one rear wall 712*b* may constitute one buffer end 712, and the configuration thereof may be designed based on the spaced distance between the front wall 712*a* and the rear wall 712*b*.

The connection wall 712*c* of the buffer end 712 is preferably such that a plurality of connection walls 712*c* may be provided and laterally spaced apart from each other. That is, configuration of the connection wall is for maximally preventing torsion of the front wall 712*a* or torsion of the rear wall 712*b*.

The spaced distance between the front wall 712*a* and the rear wall 712*b* may be shorter than or equal to a spaced distance between the connection walls 712*c*. That is, when the front wall 712*a* is bent rearward, the front wall 712*a* may hit the rear wall 712*b* due to the spaced distance, so that the shock may be maximally reduced.

A close contact end 713 (or contact edge) may be provided on an upper surface of a front end of the shock absorption part 710 to be in close contact with an edge of the front panel 210. The close contact end 713 may cover the edge of the front panel 210 to protect the covered portion and to prevent a gap between the close contact pad 711 and the lower surface of the front panel 210 to be exposed to the outside.

A height adjustment part 7 (or height adjustment device) may be provided on front opposite sides of a lower surface of the cabinet 100 to adjust the cabinet 100 higher or lower.

The height adjustment part 7 may adjust left and right heights of the refrigerator by performing manipulation for reversible rotation of an adjustment wheel 71 so that the refrigerator is horizontal. A protection cover 72 may be provided at an upper end of the adjustment wheel 71 so that the adjustment wheel 71 is minimally exposed to the outside.

In the drawer 200, a front surface of the front panel 210 is further forward than a front surface of the height adjustment part 7 (more accurately, the protection cover 72) when the drawer 200 is closed. A front surface of the buffer end 712 (of the shock absorption part 710) is further forward than the front surface of the height adjustment part 7.

As the front surface of the buffer end 712 (of the shock absorption part 710) is further forward than the height adjustment part 7, deformation of the height adjustment part 7 may be prevented, where the deformation being generated when entire buffer end 712 of the shock absorption part 710 overlaps the height adjustment part 7.

As a gap between the front surface of the front panel 210 and the protection cover 72 of the height adjustment part 7 is short, thickness of the buffer end 712 should be thin, so that a problem may occur that a sufficient buffering effect may not be obtained.

Accordingly, when the buffer end 712 is provided in plural, only a buffer end 712 positioned in front of the height adjustment part 7 among the buffer ends 712 is configured to have a thinner front to rear thickness than front to rear thicknesses of the other buffer ends. When one buffer end 712 is provided, only a portion positioned in front of the height adjustment part 7 among portions of the buffer end 712 is configured to have a thinner front to rear thickness than front to rear thicknesses of the other portions. That is, based on the structure described above, the buffer ends 712 (or portions) between two height adjustment parts 7 may have a sufficient depth.

According to an example embodiment, the shock absorption module 700 may include a pad fixing part 720 (or pad attachment).

The pad fixing part 720 may attach the shock absorption part 710 on the lower surface of the front panel 210.

The pad fixing part 720 may include an adhesive tape 721 (or other type of adhesion) (referring to FIG. 32) between an upper surface of the shock absorption part 710 and the lower surface of the front panel 210.

Considering that the shock absorption part 710 is actually formed of a rubber material, the adhesive tape 721 may be provided so that the shock absorption part 710 may be attached to the lower surface of the front panel 210.

When the pad fixing part 720 has only the adhesive tape 721, degradation in adhesive strength of the adhesive tape 721 may occur as time passes, so there is a risk of detaching the shock absorption part 710 from the lower surface of the front panel 210.

The pad fixing part 720 may be maintained in the firmly fixed state by coupling by a screw (bolt, rivet, hook or the like).

The pad fixing part 720 may be a flexible rubber material such as TPE, so that tearing of coupling portion with the screw may occur.

Accordingly, in an embodiment of the present disclosure, the pad fixing part 720 is shown as including a close contact plate 722 that is coupled to the lower surface of the front panel 210 by a connecting device (screw, bolt, rivet, hook, or the like) while being in close contact with a lower surface of the shock absorption part 710. The close contact plate 722 may be a metal plate.

That is, as the shock absorption part 710 is positioned between the close contact plate 722 and the front panel 210, and the close contact plate 722 is coupled to the front panel 210, tearing of the shock absorption part 710 may be prevented and the shock absorption part 710 may be maintained in the firmly fixed state.

A seating groove 711*a* may be provided in a depressed manner on a lower surface of the close contact pad 711 (of the shock absorption part 710). The seating groove 711*a* is where the close contact plate 722 is seated. That is, the close contact plate 722 may be seated in the seating groove 711*a* so that positioning the shock absorption part 710 between the close contact plate 722 and the front panel 210 may be facilitated.

A reinforcement end 723 may be provided on the close contact plate 722 to cover a separation portion buffer end of the lower surface of the close contact pad 711. The separation portion may be positioned between the buffer ends 712. That is, since the reinforcement end 723 is additionally provided, the separation portions between the buffer ends 712 (of the shock absorption part 710) are prevented from being detached from the lower surface of the front panel 210.

As the screw coupling (or by using bolt, rivet, hook or the like) of the close contact plate 722 is performed on a portion where the reinforcement end 723 is formed, the detachment of the buffer end 712 may be maximally prevented.

When the screw coupling using the close contact plate 722 is performed, the adhesive tape 721 may be preferably used therein together.

According to an embodiment of the present disclosure, the shock absorption part 710 of the shock absorption module 700 is not limited to the structure of the embodiment described above.

Figure 34:
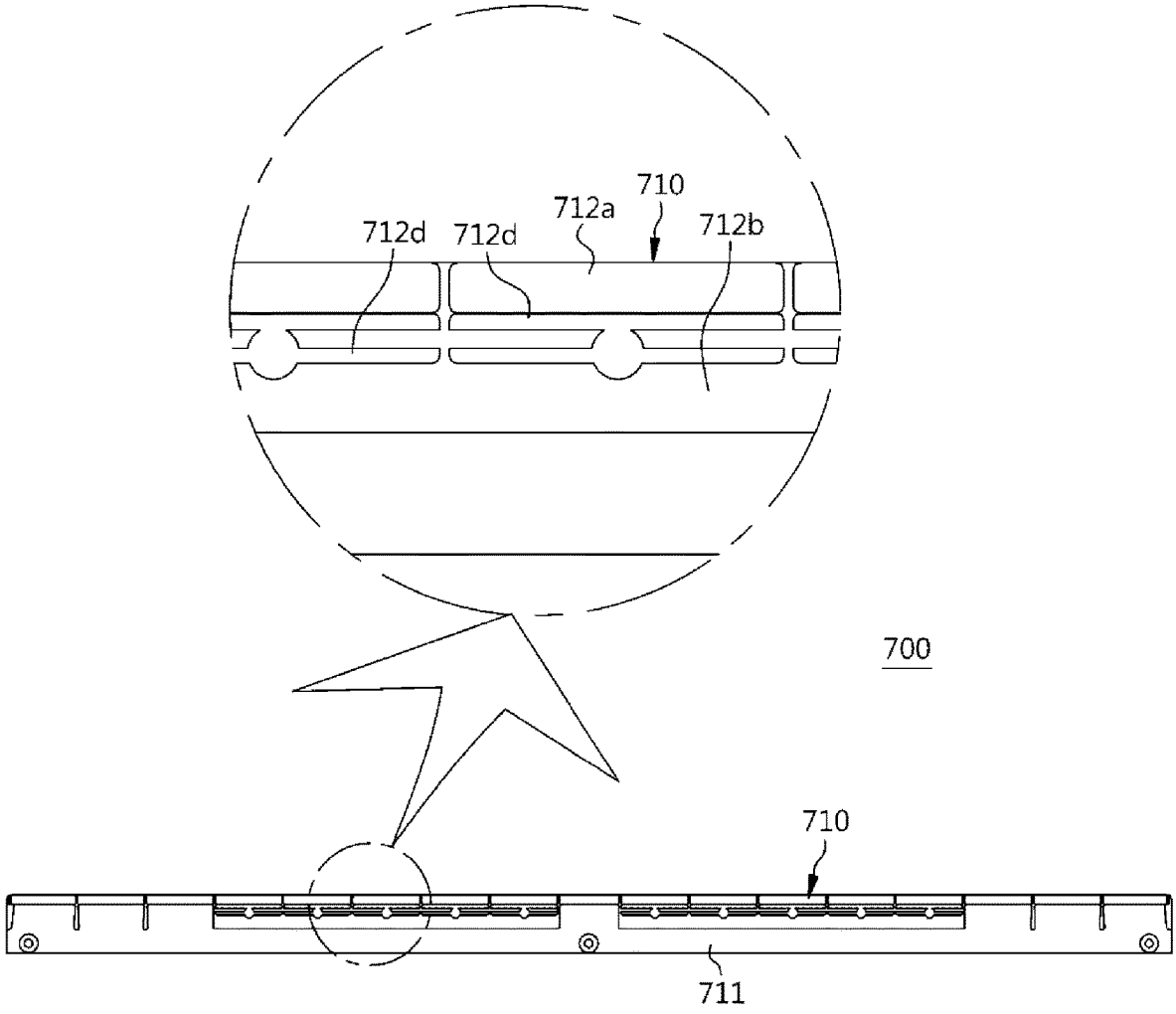

For example, as shown in FIG. 34, the buffer end 712 of the shock absorption part 710 may have a structure in which a plurality of reinforcement walls 712*d* are provided between the front wall 712*a* and the rear wall 712*b*.

Figure 35:
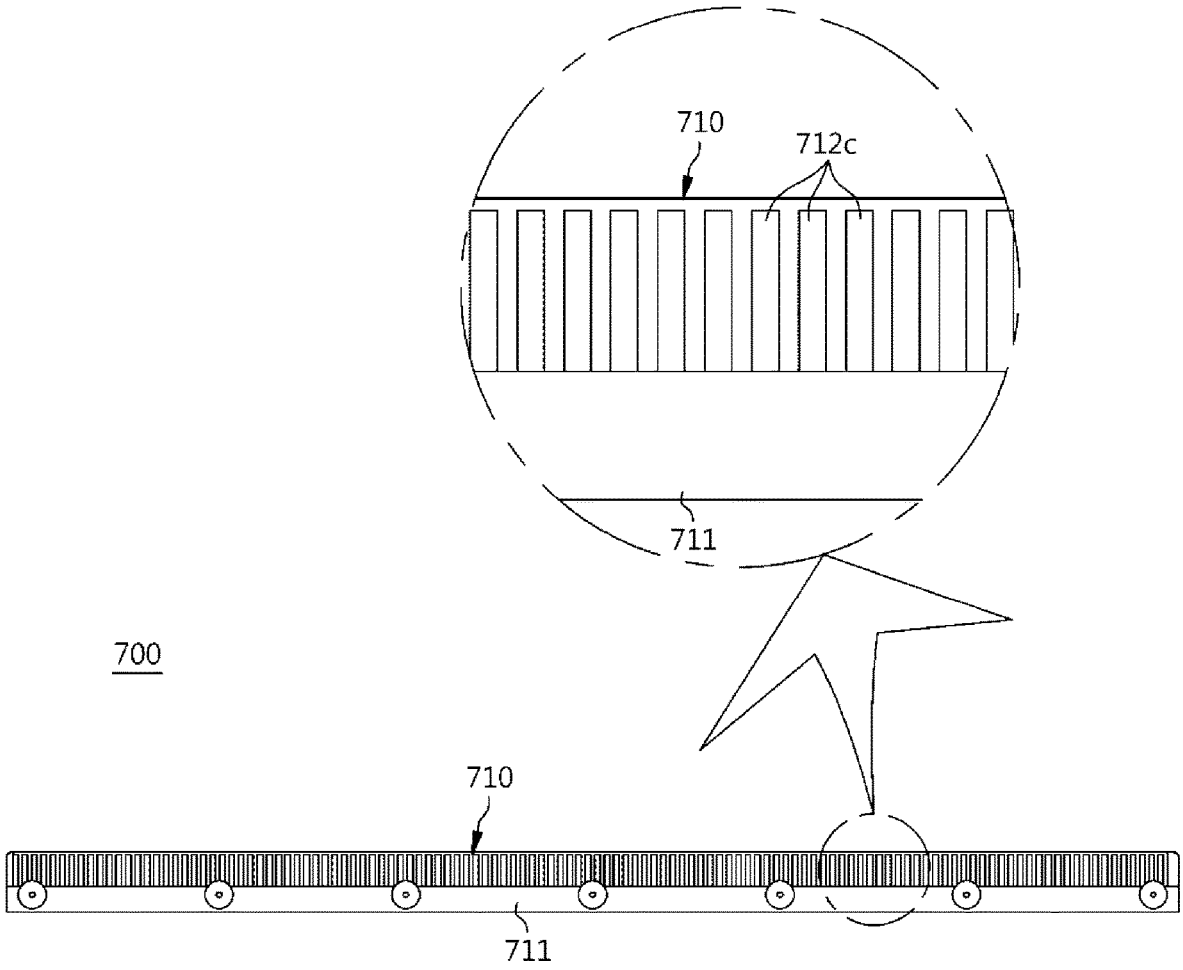
Figure 36:
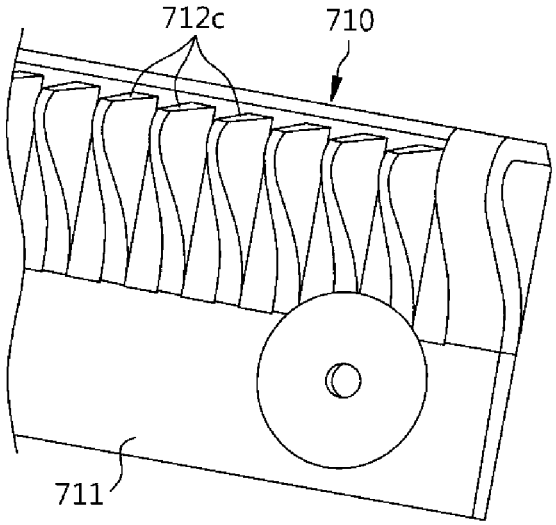
FIG. 36 is a main part perspective view showing a shape of the shock absorption module of FIG. 35.
Figure 37:
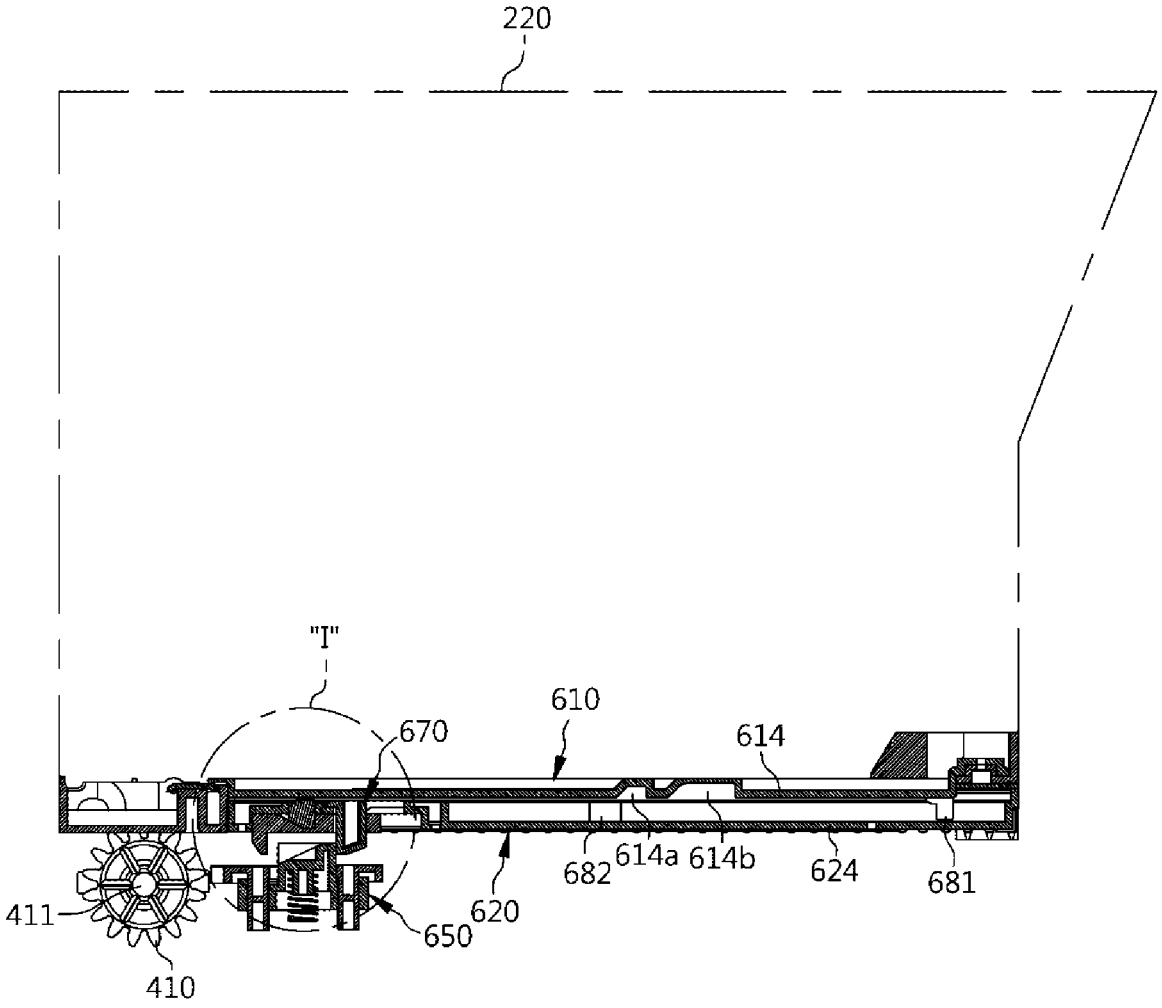
FIGS. 37, 39, 41, and 43 are views showing operational states of the rack gear assembly when a storage room of the refrigerator according to an example embodiment of the present disclosure is opened.
Figure 38:
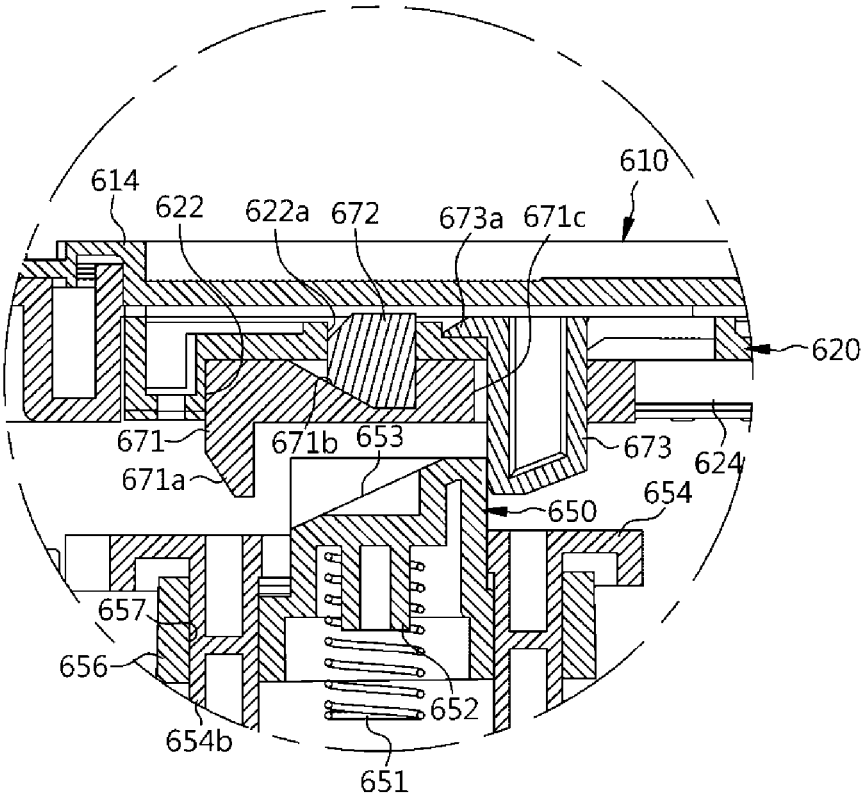
FIG. 38 is an enlarged view of "I" part in FIG. 37.
Figure 39:
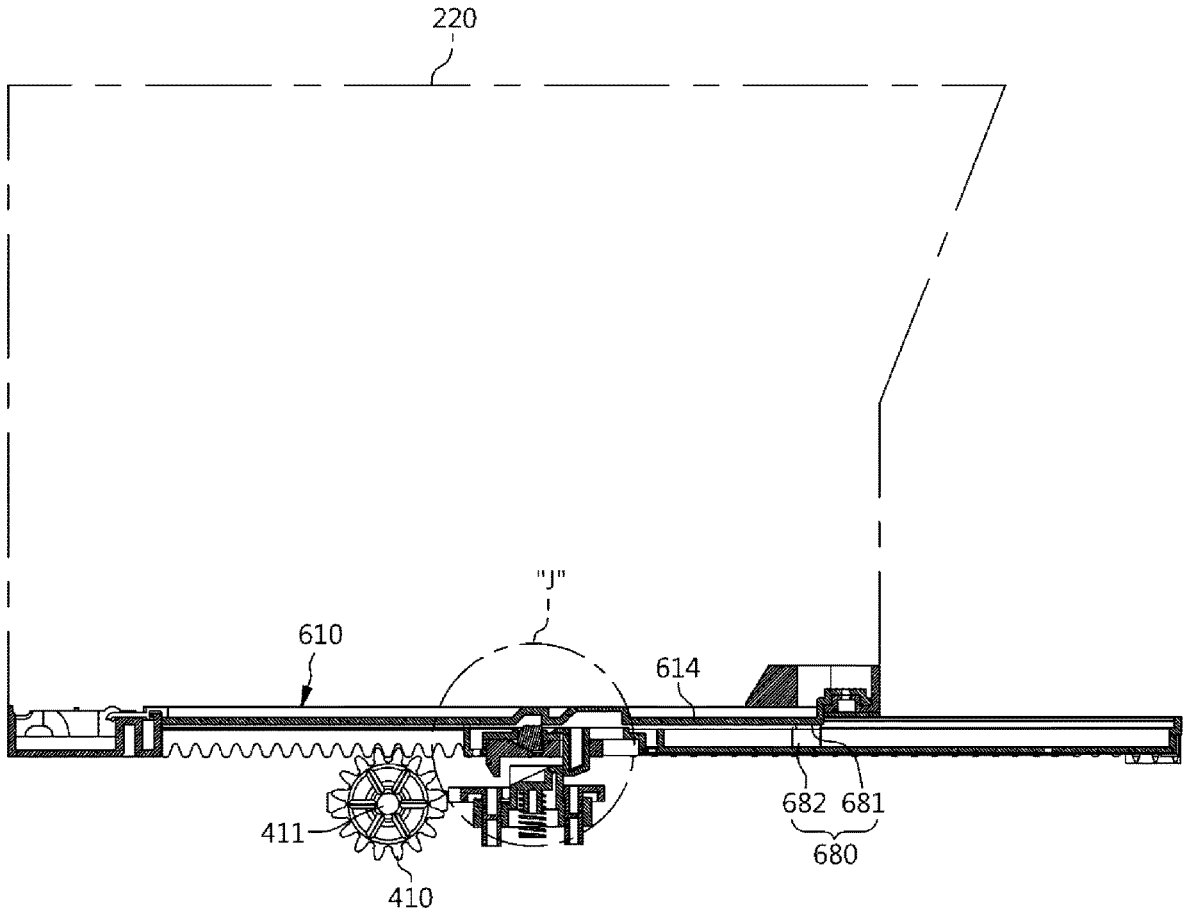
Figure 40:
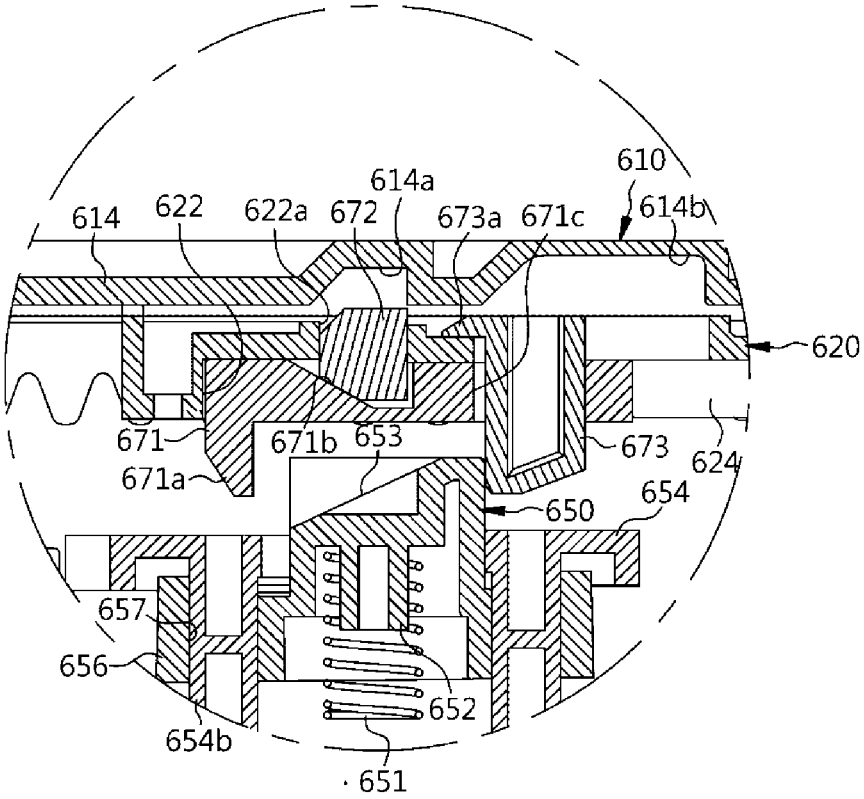
FIG. 40 is an enlarged view of "J" part in FIG. 39.
Figure 41:
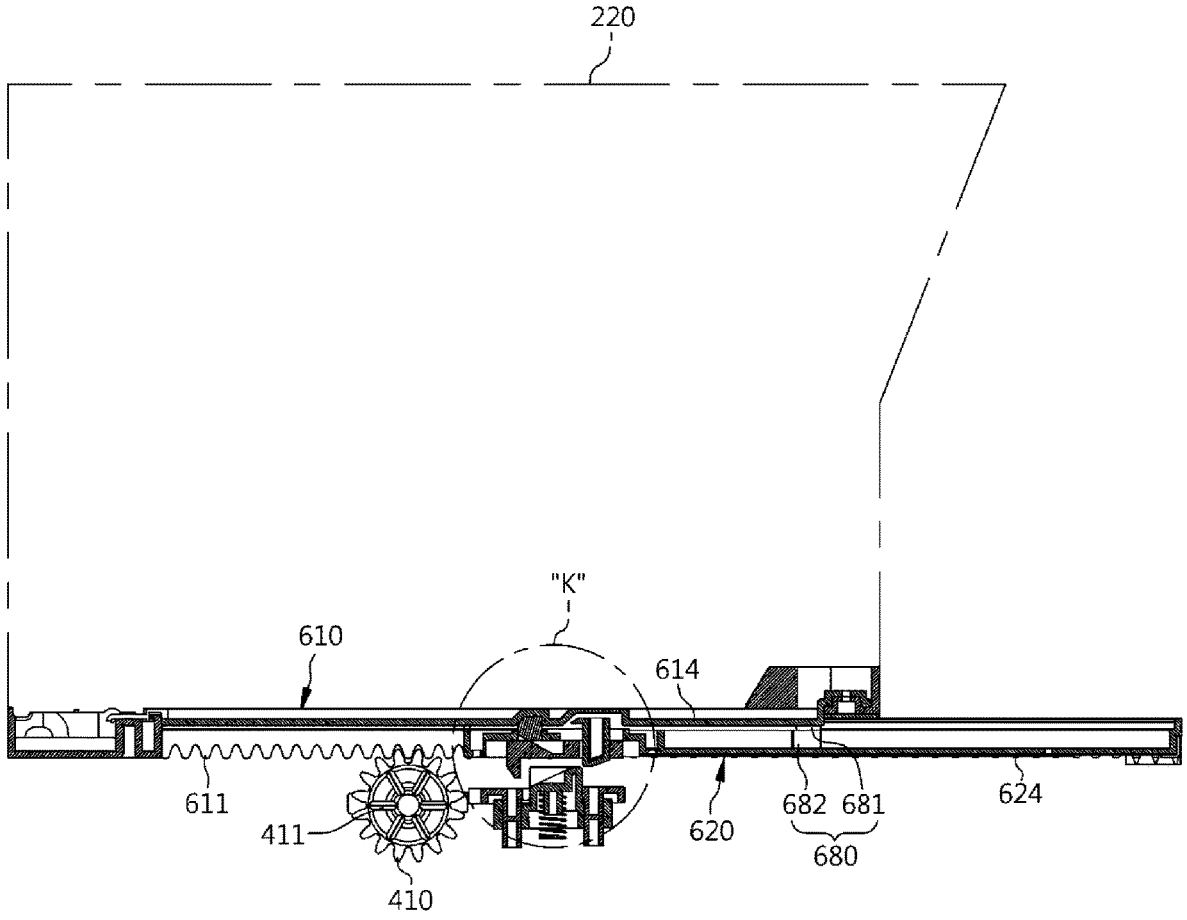
Figure 42:
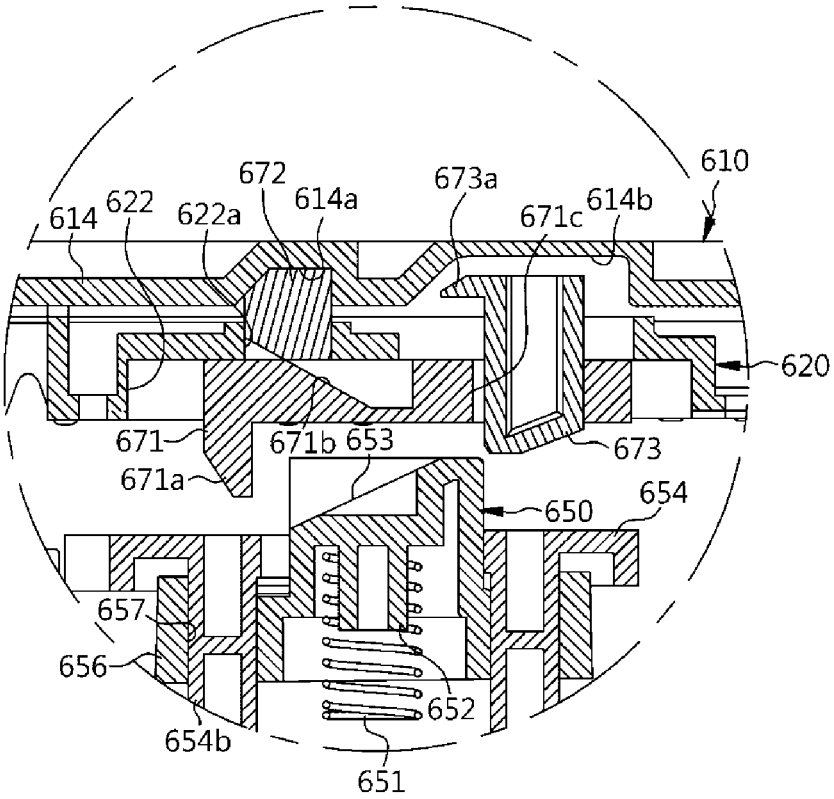
FIG. 42 is an enlarged view of "K" part in FIG. 41.
Figure 43:
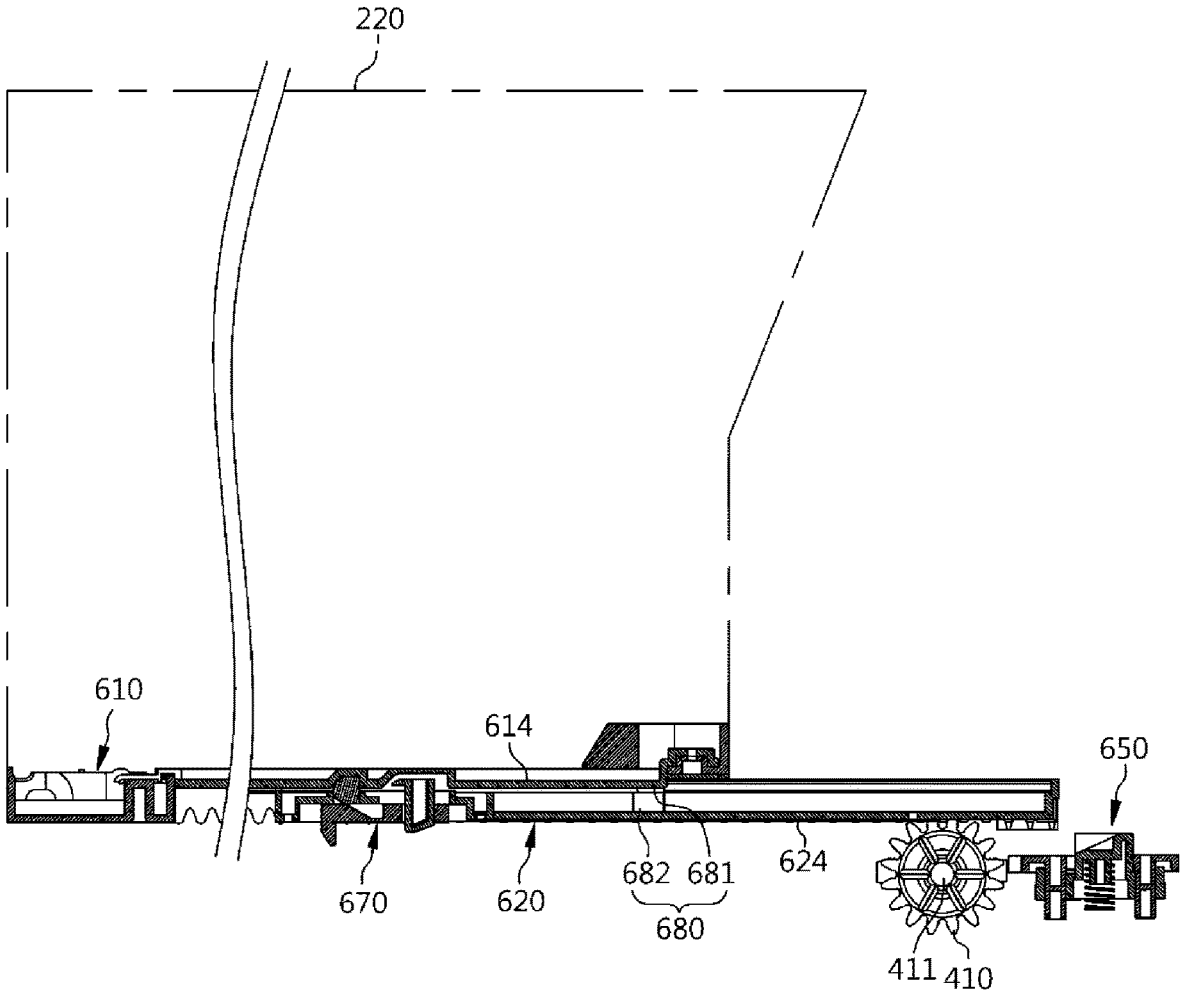

As shown in FIGS. 35 and 36, the buffer end 712 (of the shock absorption part 710) may have a structure in which the front wall 712*a* and the rear wall 712*b* are not provided and the plurality of connection walls 712*c* are only provided. Each of the connection walls 712*c* may be convex toward the center thereof so as to minimize bending deformation of the connection walls in the forward and rearward directions. Gaps between the connection walls 712*c* may further narrow in comparison with a height of the connection wall 712*c* so that a sufficient buffering effect may be obtained.

According to an embodiment of the present disclosure, operation of the refrigerator may be described with reference to FIGS. 37 to 43.

The drawer 200 may be maintained in a closed state unless otherwise manipulated. This may be shown in FIGS. 37 and 38.

In the closed state, when a manipulation is performed to open the drawer 200 at the user's need, the driving motor 420 may operate while power is supplied to the driving part 400.

The manipulation for opening the drawer 200 may be a manipulation of a button (touch or pressure type) 6 or an operation control of a control program that senses proximity of the user.

When the driving motor 420 is operated by the manipulation, the two pinions 410 may simultaneously rotate, and thus the drawer 200 is opened forward while the rack gears 611 and 621 (of the two rack gear assemblies 600 engaged with the pinions 410) are operated.

More specifically, the rack gear assemblies 600 are operated such that the first rack member 610 and the first rack cover 614 are pushed out while being operated simultaneously, and then the second rack member 620 and the second rack cover 624 are subsequently pushed out.

While the first rack member 610 and the first rack cover 614 are simultaneously operated and pushed out, the locking member 673 is maintained in a confined state to the confining protrusion part 650, so that the second rack member 620 and the second rack cover 624 are maintained in an initial position.

When the first rack member 610 and the first rack cover 614 are pushed out by the preset first distance and the linkage protrusion 681 comes into contact with the linkage step 682, the second rack member 620 and the second rack cover 624 are moved forward with the first rack member 610 from the contact point. This process may be shown in FIGS. 39 and 40.

However, the locking member 673 may be confined to the confining protrusion part 650, so the stopper member 671 through which the locking member 673 passes is maintained in place while the second rack member 620 is moved forward. In the above process, as the extended step 673*a* of the locking member 673 gradually climbs to the raising guide step 623 provided in the second rack member 620, the locking member 673 is moved upward and is separated from the confining protrusion part 650. This process may be shown in FIGS. 41 and 42.

After that, the stopper member 671 is moved forward with the second rack member 620 while contacting a rear surface in the motion groove 622 and passes the confining protrusion part 650.

Subsequently, while the second rack member 620 and the second rack cover 624 are moved following the first rack member 610 and the first rack cover 614, the rack gear 621 of the second rack member 620 is engaged with the pinion 410 just before the rack gear 611 of the first rack member 610 is separated from the pinion 410. As the rack gear 611 of the first rack member 610 is separated from the pinion 410 by rotation of the pinion 410 and at the same time only the rack gear 621 of the second rack member 620 is moved by being engaged with the pinion 410, the drawer 200 is further moved forward. This process may be shown in FIG. 43.

While the opening of the drawer 200 is performed by the above operation, when the user is in the area in the opening direction of the drawer 200, the user's foot may be sandwiched between the front panel 210 and the floor, thereby causing injury to the user's foot.

However, the shock absorption part 710 is provided on the edge of the front lower surface of the front panel 210, and the buffer end 712 of the shock absorption part 710 protrudes downward toward the floor. Therefore, the buffer end 712 functions to push the user's foot before the user's foot is positioned under the front panel 210.

Accordingly, the user can recognize danger to the foot by himself/herself and remove the foot from the opened area or move to another area so that the safety accident can be prevented.

When the user removes the foot too late, the user's foot may be sandwiched between the buffer end 712 and the floor.

However, the buffer end 712 is deformed into a bent shape by being partially pushed rearward by contact with the user's foot, thereby being placed on the user's instep. Accordingly, the shock applied to the user's foot may be buffered to minimize damage of the safety accident.

The refrigerator of the present disclosure may be provided with the shock absorption module 700 at the front panel. Accordingly, when the drawer 200 is opened, shock of the drawer caused by the hitting on the floor may be absorbed by the shock absorption module 700, so that floor damage or drawer damage can be prevented and safety accident such as hitting on a user's instep can be prevented.

In the refrigerator of the present disclosure, the shock absorption module 700 may be provided along the front edge of the lower surface of the front panel 210, so that the user can recognize the front panel 210 in advance, before the user's foot is completely positioned under the front panel.

In the refrigerator of the present disclosure, the shock absorption module 700 may be provided with the shock absorption part 710 formed of the elastomer, so that the hit portion can be prevented from being damaged or injuring even when the falling or the hitting occurs.

In the refrigerator of the present disclosure, the shock absorption part 710 may be provided with the close contact pad 711 and the buffer end 712 that are distinguished from each other, so that a stable mounting of the shock absorption part 710 may be made.

In the refrigerator of the present disclosure, the buffer end 712 of the shock absorption part 710 is made up the plurality of walls 712*a*, 712*b*, and 712*c*, so that floor and door damages and user's foot injury caused by the hitting in the forward and rearward directions can be minimized.

In the shock absorption part 710, the rear wall 712*b* may be inclined such that the lower portion thereof is further forward, so that a greater buffering force can be provided.

In the refrigerator of the present disclosure, the shock absorption part 710 may be provided with the at least two buffer ends 712 and the buffer ends are laterally spaced apart from each other. Accordingly, when shock is applied to a sectional area of the front panel, detachment of the shock absorption part separated from the lower surface of the front panel 210 can be minimized.

In the refrigerator of the present disclosure, the shock absorption part 710 may be provided such that the connection wall 712*c* of the buffer end 712 is provided in plural, and the connection walls 712*c* are may be spaced apart from each other, so that improved buffering force can be provided.

In the refrigerator of the present disclosure, the shock absorption part 710 may be configured such that the spaced distance between the front and rear walls 712*a* and 712*b* of the buffer end 712 is shorter than or equal to the spaced distance between the connection walls 712*c*, so that the improved buffering force can be provided.

In the refrigerator of the present disclosure, the shock absorption module 700 may include the pad fixing part 720 so that the shock absorption part 710 can be stably fixed to the lower surface of the front panel 210 and damage to the shock absorption part 710 can be prevented during fixation.

In the refrigerator of the present disclosure, the shock absorption module 700 may be provided with the adhesive tape 721 (or other connection device) between the opposed surfaces on the shock absorption part 710 and the front panel 210, so that coupling operation between the shock absorption part 710 and the front panel 210 can be easily performed.

In the refrigerator of the present disclosure, the shock absorption module 700 may be provided with the close contact plate 722 on the lower surface of the shock absorption part 710, so that the shock absorption part 710 can be stably fixed to the lower surface of the front panel 210 without tearing or damage.

In the refrigerator of the present disclosure, the close contact plate 722 (of the shock absorption module 700) is a metal plate, so that the fixation of the shock absorption part 710 can be firm.

In the refrigerator of the present disclosure, the close contact plate 722 (of the shock absorption module 700) has the reinforcement end 723 so that the separation portion of the lower surface of the close contact pad 711 can be stably fixed to the lower surface of the front panel, where the separation portion is positioned between the buffer ends 712.

In the refrigerator of the present disclosure, the shock absorption module 700 may be configured such that the screwing or bolting (or connecting) of the close contact plate 722 may be performed on the portion where each reinforcement end 723 is formed, so that entire part of the shock absorption part 710 can be stably maintained in the fixed state.

In the refrigerator of the present disclosure, the seating groove 711*a* may be formed on the lower surface of the shock absorption part 710, so that the close contact plate 722 can be combined with the shock absorption part 710 while being seated precisely in place, and coupling between the shock absorption part 710 and the front panel 210 can be performed precisely and easily.

In the refrigerator of the present disclosure, when the drawer 200 is closed, the front surface of the front panel 210 (of the drawer 200) is further forward than the front surface of the height adjustment part 7, so that the shock absorption part 710 is overlapped with the height adjustment part 7, and deformation thereof can be prevented.

In the refrigerator of the present disclosure, the front surface of the buffer end 712 (of the shock absorption part 710) may be positioned further forward than the front surface of the height adjustment part 7, so that the buffer end 712 is overlapped with the height adjustment part 7, and deformation thereof can be prevented.

In the refrigerator of the present disclosure, the buffer end 712 (of the shock absorption part 710) is provided as at least two buffer ends and the buffer ends 712 are laterally spaced apart from each other, and one buffer end 712, which is in front of the height adjustment part 7, of the buffer ends 712 has the thinner front to rear thickness than front to rear thicknesses of the others of the buffer ends. Accordingly, deformation caused by overlapping with the height adjustment part 7 may be prevented and thicknesses of the other buffer ends are sufficiently thick, so that a buffering effect can be obtained at a desired degree.

In the refrigerator of the present disclosure, the close contact end 713 may be provided on the upper surface of the front end of the shock absorption part 710, so that the gap between the front panel 210 and the shock absorption part 710 can be prevented from being exposed to the outside.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019 (Attorney Docket No. NIP-0003), U.S. application Ser. No. 16/582,647 filed Sep. 25, 2019 (Attorney Docket No. NIP-0004), U.S. application Ser. No. 16/582,518 filed Sep. 25, 2019 (Attorney Docket No. NIP-0005), U.S. application Ser. No. 16/582,605 filed Sep. 25, 2019 (Attorney Docket No. NIP-0006), U.S. application Ser. No. 16/582,712 filed Sep. 25, 2019 (Attorney Docket No. NIP-0007), U.S. application Ser. No. 16/582,756 filed Sep. 25, 2019 (Attorney Docket No. NIP-0008), U.S. application Ser. No. 16/582,810 filed Sep. 25, 2019 (Attorney Docket No. NIP-0009), U.S. application Ser. No. 16/582,668 filed Sep. 25, 2019 (Attorney Docket No. NIP-0010), U.S. application Ser. No. 16/582,755 filed Sep. 25, 2019 (Attorney Docket No. NIP-0011), U.S. application Ser. No. 16/585,284 filed Sep. 27, 2019 (Attorney Docket No. NIP-0013), U.S. application Ser. No. 16/585,301 filed Sep. 27, 2019 (Attorney Docket No. NIP-0014), and U.S. application Ser. No. 16/585,816 filed Sep. 27, 2019 (Attorney Docket No. NIP-0015), whose entire disclosures are also hereby incorporated by reference.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such the drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber; and a shock absorber provided at a lower surface of the front panel to absorb a shock caused by touching a surface when the drawer is opened, wherein the shock absorber includes a shock absorption component formed of an elastomer, wherein the shock absorption component comprises a contact pad in contact with the lower surface of the front panel and a buffer end to protrude downward from a front lower surface of the contact pad, wherein the buffer end comprises a front wall to form a front surface, a rear wall to form a rear surface and, a connection wall to connect the front wall and the rear wall, wherein the rear wall of the buffer end is inclined such that a lower portion of the rear wall is positioned more forward than an upper portion of the rear wall.

2. The refrigerator of claim 1, wherein the shock absorber is along a front edge of the lower surface of the front panel.

3. The refrigerator of claim 1, wherein the buffer end includes at least two buffer ends, and the buffer ends are laterally spaced apart from each other.

4. The refrigerator of claim 1, wherein the connection wall includes a plurality of connection walls, and the connection walls are laterally spaced apart from each other.

5. The refrigerator of claim 4, wherein a spaced distance between the front wall and the rear wall of the buffer end is shorter than or equal to a spaced distance between two of the connection walls.

6. The refrigerator of claim 1, wherein the shock absorption component includes a contact edge to cover an edge of the front panel, the contact edge being on an upper surface of a front end of the shock absorption component.

7. A refrigerator comprising:

a cabinet having an opening to access a storage chamber provided within the cabinet;

a drawer including a front panel and a storage bin coupled to a rear of the front panel, the drawer being coupled to the cabinet such the drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber; and a shock absorber provided at a lower surface of the front panel to absorb a shock caused by touching a surface when the drawer is opened, wherein the shock absorber includes a shock absorption component formed of an elastomer, wherein the shock absorption component comprises a contact pad in contact with the lower surface of the front panel and a buffer end to protrude downward from a front lower surface of the contact pad, wherein the shock absorber includes a pad attachment to attach the shock absorption component to the lower surface of the front panel, wherein the pad attachment includes a contact plate, the contact plate to contact with a lower surface of the shock absorption component, and the contact plate is to couple to the lower surface of the front panel by a connection device.

8. The refrigerator of claim 7, wherein the pad attachment includes an adhesive device provided between a surface of the shock absorption component and a surface of the front panel.

9. The refrigerator of claim 7, wherein the contact plate is a metal plate.

10. The refrigerator of claim 9, wherein the buffer end includes at least two buffer ends, and the buffer ends are laterally spaced apart from each other, and the contact plate has a reinforcement end that covers a spaced portion of the lower surface of the contact pad between the buffer ends.

11. The refrigerator of claim 10, wherein the connection device is at a portion of the contact plate where the reinforcement end is provided.

12. The refrigerator of claim 7, wherein a seating groove is provided on the lower surface of the shock absorption component such that the contact plate is seated thereon.

13. A refrigerator comprising:

a cabinet having an opening to access a storage chamber provided within the cabinet;

a drawer including a front panel and a storage bin coupled to a rear of the front panel, the drawer being coupled to the cabinet such the drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

a shock absorber provided at a lower surface of the front panel to absorb a shock caused by touching a surface when the drawer is opened; and height adjustment devices provided at a lower surface of the cabinet to adjust a height of the cabinet, wherein the shock absorber includes a shock absorption component formed of an elastomer, wherein the shock absorption component comprises a contact pad in contact with the lower surface of the front panel and a buffer end to protrude downward from a front lower surface of the contact pad, wherein a front surface of the front panel is further forward than the height adjustment devices when the drawer is closed, wherein the buffer end of the shock absorption component includes at least two buffer ends, and the buffer ends are laterally spaced apart from each other, and one of the buffer ends positioned in front of the height adjustment devices is configured to have a thinner front to rear thickness than a front to rear thickness of another buffer end.

14. The refrigerator of claim 13, wherein a front surface of the buffer end of the shock absorption component is further forward than front surfaces of the height adjustment devices.

* * * * *